US008159134B2

(12) United States Patent
Eden et al.

(10) Patent No.: US 8,159,134 B2
(45) Date of Patent: Apr. 17, 2012

(54) ARRAYS OF MICROCAVITY PLASMA DEVICES AND ELECTRODES WITH REDUCED MECHANICAL STRESS

(75) Inventors: J. Gary Eden, Champaign, IL (US); Sung-Jin Park, Savoy, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 747 days.

(21) Appl. No.: 12/152,550

(22) Filed: May 15, 2008

(65) Prior Publication Data

US 2010/0001629 A1 Jan. 7, 2010

Related U.S. Application Data

(60) Provisional application No. 60/930,393, filed on May 16, 2007.

(51) Int. Cl.
*H01J 17/04* (2012.01)

(52) U.S. Cl. ..... 313/631; 313/634; 313/586

(58) Field of Classification Search ..... 313/582–587, 313/483–494, 631, 461, 306, 618, 326, 352, 313/311; 315/169.3, 169.4; 445/24–26, 445/29, 46

See application file for complete search history.

(56) References Cited

U.S. PATENT DOCUMENTS 3,551,303 A 12/1970 Suzuki et al.
5,194,136 A 3/1993 Jeung et al.
5,441,627 A 8/1995 Kato et al.
5,841,219 A * 11/1998 Sadwick et al. ..... 313/293
5,903,040 A * 5/1999 Hong ..... 257/510

(Continued)

FOREIGN PATENT DOCUMENTS

GB 2 012 305 7/1979

(Continued)

OTHER PUBLICATIONS

J. G. Eden, et al., "Microplasma Devices Fabricated in Silicon, Ceramic, and Metal/Polymer Structures: Arrays, Emitters and Photodetectors", *Journal of Physics D: Applied Physics*, vol. 36, 2003, pp. 2869-2877.

(Continued)

*Primary Examiner* — Toan Ton
*Assistant Examiner* — Fatima Farokhrooz
(74) *Attorney, Agent, or Firm* — Greer, Burns & Crain Ltd.

(57) ABSTRACT

A preferred embodiment low stress electrode and a preferred array of microcavity plasma devices of the invention include a plurality of thin metal first electrodes and stress reduction structures and/or geometries designed to promote the flatness during and after processing. The first electrodes are buried in a thin metal oxide layer which protects the electrodes from the plasma in the microcavities. In embodiments of the invention, some or all of the electrodes are connected. Patterns of connections in a one- or two-dimensional array of microcavities can be defined. In preferred embodiments, the first electrodes comprise circumferential electrodes that surround individual microcavities. A second thin layer having a buried, second electrode is bonded to the first thin layer. A packaging layer, e.g., a thin glass or plastic layer, seals the discharge medium (a gas or vapor, or a combination of the two) into the microcavities. In a preferred methods of formation of arrays of microcavity plasma devices or electrodes, a thin metal foil or film is symmetrically anodized and formed with a stress reduction geometry and/or structures.

24 Claims, 18 Drawing Sheets

U.S. PATENT DOCUMENTS

| | | | | |
|---|---|---|---|---|
| 6,016,027 | A | 1/2000 | DeTemple et al. | |
| 6,139,384 | A | 10/2000 | DeTemple et al. | |
| 6,194,833 | B1 | 2/2001 | DeTemple et al. | |
| 6,541,915 | B2 | 4/2003 | Eden et al. | |
| 6,563,257 | B2 | 5/2003 | Vojak et al. | |
| 6,695,664 | B2 | 2/2004 | Eden et al. | |
| 6,815,891 | B2 | 11/2004 | Eden et al. | |
| 6,828,730 | B2 | 12/2004 | Eden et al. | |
| 6,853,117 | B2 * | 2/2005 | Toshima et al. | 313/304 |
| 6,867,548 | B2 | 3/2005 | Eden et al. | |
| 7,112,918 | B2 | 9/2006 | Eden et al. | |
| 7,126,266 | B2 | 10/2006 | Park et al. | |
| 2002/0113553 | A1 | 8/2002 | Vojak et al. | |
| 2003/0025438 | A1 * | 2/2003 | Asaki et al. | 313/477 R |
| 2003/0080688 | A1 | 5/2003 | Eden et al. | |
| 2003/0132693 | A1 | 7/2003 | Eden et al. | |
| 2004/0058537 | A1 | 3/2004 | Yanagita et al. | |
| 2004/0100194 | A1 | 5/2004 | Eden et al. | |
| 2004/0206959 | A1 | 10/2004 | Heeger et al. | |
| 2004/0247935 | A1 | 12/2004 | Bladt | |
| 2005/0142379 | A1 * | 6/2005 | Juni et al. | 428/690 |
| 2005/0148270 | A1 * | 7/2005 | Eden et al. | 445/24 |
| 2005/0269953 | A1 | 12/2005 | Eden et al. | |
| 2006/0038490 | A1 | 2/2006 | Eden et al. | |
| 2006/0066228 | A1 | 3/2006 | Antoniadis et al. | |
| 2006/0071592 | A1 | 4/2006 | Narasimhan et al. | |
| 2006/0071598 | A1 | 4/2006 | Eden et al. | |
| 2006/0082319 | A1 * | 4/2006 | Eden et al. | 315/169.3 |
| 2006/0084262 | A1 | 4/2006 | Qin | |
| 2006/0180474 | A1 | 8/2006 | Fujimoto | |
| 2006/0284558 | A1 | 12/2006 | Kwon et al. | |
| 2007/0108906 | A1 | 5/2007 | Kang et al. | |
| 2007/0108910 | A1 | 5/2007 | Eden et al. | |
| 2007/0170866 | A1 | 7/2007 | Eden et al. | |
| 2007/0236146 | A1 | 10/2007 | Kang et al. | |

FOREIGN PATENT DOCUMENTS

| | | | |
|---|---|---|---|
| JP | 36117777 | * | 8/1996 |
| JP | 2004-211116 | | 7/2004 |
| JP | 2005-256071 | | 9/2005 |
| KR | 10-2005-0113533 | | 2/2005 |
| WO | WO 2007/011865 | | 1/2007 |

OTHER PUBLICATIONS

O. Jessensky, F. Muller, U. Gosele, "Self-Organized Formation of Hexagonal Pore Arrays in Anodic Alumina", *Applied Physics Letters*, vol. 72, No. 10, Mar. 9, 1998, pp. 1173-1175.

H. Masuda, K. Fukuda, "Ordered Metal Nanohole Arrays Made by a Two-Step Replication of Honeycomb Structures of Anodic Alumina", *Science*, vol. 268, No. 5216, Jun. 9, 1995, pp. 1466-1468.

S.J. Park, C.J. Wagner, C.M. Herring, J.G. Eden, "Flexible Microdischarge Arrays: Metal/Polymer Devices", *Applied Physics Letters*, vol. 77, No. 7, Jul. 10, 2000, pp. 199-201.

S.J. Park, C.J. Wagner, J.G. Eden, "Performance of Microdischarge Devices and Arrays with Screen Electrodes", *IEEE Photonics Technology Letters*, vol. 13, No. 1, Jan. 2001, pp. 61-63.

Park, S-J, et. al, "Nanoporous alumina as a dielectric for microcavity plasma devices: Multilayer $Al/Al_2O_3$*", Applied Physics Letters*, vol. 86, No. 22, May 24, 2005.

Park, S-J, et. al, "Ultarviolet emission intensity, visible luminance, and electrical characteristics of small arrays of $Al/Al_2O_3$ microcaviyt plasma devices operating $Ar/N_2$ or NE at high-power loadings", *Journal of Applied Physics*, vol. 99, No. 2, Jan. 26, 2006.

* cited by examiner

ARRAYS OF MICROCAVITY PLASMA DEVICES AND ELECTRODES WITH REDUCED MECHANICAL STRESS

PRIORITY CLAIM AND REFERENCE TO RELATED APPLICATION

This application claims priority under 35 U.S.C. §119 from prior provisional application Ser. No. 60/930,393, filed May 16, 2007.

STATEMENT OF GOVERNMENT INTEREST

This invention was made with Government assistance under U.S. Air Force Office of Scientific Research grant Nos. F49620-03-1-0391 and AF FA9550-07-1-0003. The Government has certain rights in this invention.

FIELD OF THE INVENTION

The invention is in the field of microcavity plasma devices, also known as microdischarge devices or microplasma devices.

BACKGROUND

Microcavity plasma devices produce a nonequilibrium, low temperature plasma within, and essentially confined to, a cavity having a characteristic dimension d below approximately 500 μm. This new class of plasma devices exhibits several properties that differ substantially from those of conventional, macroscopic plasma sources. Because of their small physical dimensions, microcavity plasmas normally operate at gas (or vapor) pressures considerably higher than those accessible to macroscopic devices. For example, microplasma devices with a cylindrical microcavity having a diameter of 200-300 μm (or less) are capable of operation at rare gas (as well as $N_2$ and other gases tested to date) pressures up to and beyond one atmosphere.

Such high pressure operation is advantageous. An example advantage is that, at these higher pressures, plasma chemistry favors the formation of several families of electronically-excited molecules, including the rare gas dimers ($Xe_2$, $Kr_2$, $Ar_2$, . . . ) and the rare gas-halides (such as XeCl, ArF, and $Kr_2F$) that are known to be efficient emitters of ultraviolet (UV), vacuum ultraviolet (VUV), and visible radiation. This characteristic, in combination with the ability of microplasma devices to operate in a wide range of gases or vapors (and combinations thereof), offers emission wavelengths extending over a broad spectral range. Furthermore, operation of the plasma in the vicinity of atmospheric pressure minimizes the pressure differential across the packaging material when a microplasma device or array is sealed.

Research by the present inventors and colleagues at the University of Illinois has resulted in new microcavity plasma device structures as well as applications. As an example, semiconductor fabrication processes have been adapted to produce large arrays of microplasma devices in silicon wafers with the microcavities having the form of an inverted pyramid. Arrays with 250,000 devices, each device having an emitting aperture of 50×50 $\mu m^2$, have been demonstrated with a device packing density and array filling factor of $10^4$ $cm^{-2}$ and 25%, respectively. Other microplasma devices have been fabricated in ceramic multilayer structures, photodefinable glass, and $Al/Al_2O_3$ structures.

Microcavity plasma devices developed over the past decade have a wide variety of applications. An exemplary application for a microcavity plasma device array is to a display. Since the diameter of single cylindrical microcavity plasma devices, for example, is typically less than 200-300 μm, devices or groups of devices offer a spatial resolution that is desirable for a pixel in a display. In addition, the efficiency of a microcavity plasma device can exceed that characteristic of conventional plasma display panels, such as those in high definition televisions.

Early microcavity plasma devices exhibited short lifetimes because of exposure of the electrodes to the plasma and the ensuing damage caused by sputtering. Polycrystalline silicon and tungsten electrodes extend lifetime but are more costly materials and difficult to fabricate.

Large-scale manufacturing of microcavity plasma device arrays benefits from structures and fabrication methods that reduce cost and increase reliability. Of particular interest in this regard are the electrical interconnections between devices in a large array. If the interconnect technology is difficult to implement or if the interconnect pattern is not easily reconfigurable, then manufacturing costs are increased and potential commercial applications may be restricted. Such considerations are of increasing importance as the demand rises for displays or light-emitting panels of larger area.

The present inventors have previously developed low cost, large scale arrays and self-patterned formation methods. PCT Publication No. WO 2008/013820, entitled Buried Circumferential Electrode Microcavity Plasma Device Arrays, and Self-Patterned Formation Method, describes microcavity plasma device arrays with circumferential (ring) electrodes that are buried in a thin metal oxide layer and surround the microcavities, while being protected from plasma in the microcavities by a thin layer of metal oxide. The microcavity plasma device arrays can be formed by a self-patterned formation process in which one or more self-patterned metal electrodes are automatically formed and buried in the metal oxide during the anodization process. The electrodes form as a ring around each microcavity, and can be electrically isolated from, or connected to, the ring electrodes associated with adjacent microcavities.

As the area of arrays of microplasma devices and the device packing density (number of devices per unit area) are scaled to larger values, maintaining flatness of the array can become problematic. Stress in such arrays, the result of a mismatch in the coefficients of thermal expansion for the metal and metal oxide, can cause buckling of the entire array structure and distortion in the electrode and microcavity patterns in the arrays. For example, Al and $Al_2O_3$ have significantly different coefficients of thermal expansion. Such effects may not present difficulties for array sizes of a few $cm^2$ and device packing densities on the order of $10^2$ $cm^{-2}$ (or less) but can have a deleterious impact on array performance as the area of the array and the packing density rise.

SUMMARY OF THE INVENTION

A preferred embodiment low stress array of microcavity plasma devices of the invention includes a plurality of thin metal first electrodes and stress reduction structures and/or geometries that promote flatness of the arrays. The first electrodes are buried in a thin metal oxide layer which protects the electrodes from the plasma in the microcavities. In embodiments of the invention, some or all of the electrodes are connected. In preferred embodiments, the first electrodes comprise circumferential electrodes that surround individual microcavities. Patterns of connections in a one- or two-dimensional array of microcavities can be defined. A second thin layer having a buried, second electrode is bonded to the first thin layer. A packaging layer, e.g., a thin glass or plastic layer, seals the discharge medium (a gas or vapor or a combination of gases and/or vapors) into the microcavities. The invention further provides thin sheets of metal and metal oxide electrodes with stress reduction structures and/or geometries. Low stress metal/metal oxide electrodes of the invention include common electrodes of a thin foil having support ribs and parallel lines of thin metal electrodes with uniform geometry.

In a preferred method of formation embodiment, a thin metal foil or film is obtained or formed with microcavities (such as through holes). The foil or film is anodized symmetrically so as to form a metal-oxide film on the surface of the foil and on the walls of the microcavities. One or more self-patterned metal electrodes are automatically formed and simultaneously buried in the metal oxide created by the anodization process. The electrodes form in a closed circumference around each microcavity, and electrodes for adjacent microcavities can be isolated or connected. If the microcavity is cylindrical, the electrodes form as rings around each cavity.

DETAILED DESCRIPTION OF THE PREFERRED EMBODIMENTS

Figure 1:
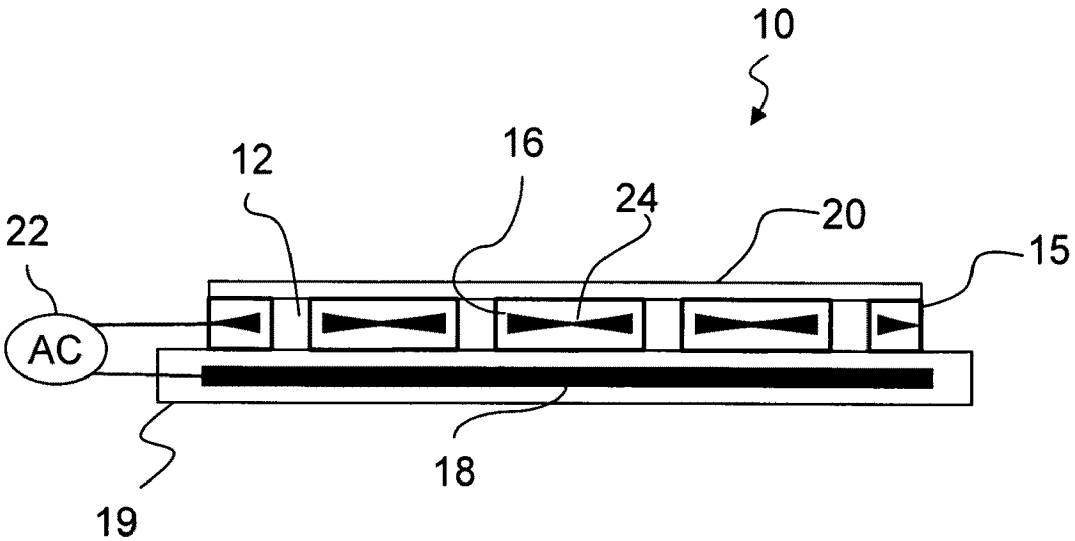
FIG. 1 is a schematic cross-sectional view of an exemplary embodiment array of microcavity plasma devices of the invention.

A preferred embodiment array of microcavity plasma devices of the invention includes a plurality of thin first electrodes that surround microcavities in the device in a plane(s) transverse to the microcavities. The first electrodes are buried in a thin metal oxide layer and stress reduction structures and/or geometry are incorporated into the array design to promote flatness of the overall array. In embodiments of the invention, some or all of the electrodes are connected and the metal oxide surrounding the electrodes physically isolates the electrodes from plasma produced within the microcavities, thereby protecting the electrodes from chemical and/or physical degradation arising from contact with the plasma. Electrode connection patterns can be defined. In preferred embodiments, the first electrodes comprise circumferential electrodes that surround individual microcavities.

A second electrode is buried in a second dielectric layer. The second dielectric layer is bonded to, or brought in close proximity to, the first layer and a packaging layer seals gas or vapor (or a combination thereof) within the array.

The second thin layer can include, for example, a common electrode. The second layer can be a solid thin metal foil buried in, or encapsulated by, an oxide film so as to define a common second electrode. In other embodiments, the second thin layer can include an electrode pattern, with or without microcavities. Preferably, the second layer is formed similarly to the first layer with thin foil circumferential buried electrodes and including stress reduction structures and/or geometry to promote flatness of the overall array. Such an array provides low capacitance (and, therefore, reduced displacement current) and high switching speed. Microplasma device arrays of the invention can be flexible, lightweight and inexpensive. The invention further provides thin sheets of metal and metal oxide electrodes with stress reduction structures and/or geometries. Low stress metal/metal oxide electrodes of the invention include common electrodes of a thin foil having support ribs and parallel lines of thin metal electrodes with uniform geometry.

In a preferred method of formation embodiment, a thin metal foil (or film) is obtained or formed with microcavities (such as through holes). The foil is symmetrically anodized to form a nanoporous metal oxide on both surfaces of the foil as well as on the walls of the microcavities. One or more self-patterned metal electrodes are automatically formed and buried in the metal oxide created by the anodization process. The electrodes form in a closed circumference around each microcavity, and can be isolated from electrodes associated with other microcavities, or the electrodes for one or more microcavities can be interconnected in a one- or two-dimensional pattern.

A preferred embodiment microplasma device array of the invention has at least a subset of the microcavities interconnected. First thin metal circumferential electrodes are buried in a metal-oxide (dielectric) layer and at least two of the first thin metal circumferential electrodes are interconnected. The array includes stress reduction structures and/or geometry to promote flatness even with thin, narrow electrodes and close-packing of the microcavities within the array. Large arrays can be formed that maintain flatness, despite the difference between the coefficients of thermal expansion for the metal and metal oxide. Metal-oxide also covers the wall of each microcavity so as to protect the first thin metal circumferential electrodes from exposure to the plasma. A second electrode(s) is also buried in a second metal-oxide dielectric layer which is brought in close proximity to the first layer with the first electrode with its microcavity array, and preferably includes stress reduction structures or geometry. This second electrode can, for example, comprise parallel metal lines buried in dielectric and intended to be associated with a row or column of microcavities in the array in the first layer. The second electrode can, alternatively, be a thin continuous sheet of metal buried in a dielectric. Microcavities may or may not be formed in the second electrode.

Microcavity devices and arrays are provided by embodiments of the invention in which thin planar circumferential metal electrodes, lying in a plane(s) transverse to a plurality of microcavities, provide power to, and interconnections among, the microcavities. Electrodes are buried in a dielectric, such as a metal oxide, and surround each microcavity. The shape of the electrode around the microcavity essentially replicates the cross-sectional geometry of the microcavity (circular, diamond, etc.). A thin film of the dielectric lies between the electrode and the edge (wall) of the microcavity, thereby electrically insulating the electrode and providing chemical and physical isolation of the electrode from the plasma within the microcavity. That is, the electrode is not flush with the microcavity wall. The array includes stress reduction structures or geometry to maintain flatness of the overall array even with thin, narrow electrodes and interconnects and close-packing of the microcavities within the array. Large arrays can be formed that maintain flatness over areas of hundreds of $cm^2$ and beyond.

A preferred embodiment array includes a plurality of first circumferential electrodes buried in a dielectric film and some or all of these electrodes are connected. A second electrode is buried in a second dielectric layer. The second dielectric layer is bonded or otherwise brought in proximity to the first layer, forming an array of devices, and a packaging layer seals the desired gas(es) or vapor(s) (or a combination thereof) within the array. In embodiments of the invention, the electrodes associated with different microcavities can be interconnected in patterns that are controllable. The array includes stress reduction structures or geometry to promote flatness of the array even with narrow, thin electrodes and close-packing of the microcavities within the array. Large arrays can be formed that maintain flatness over areas of at least hundreds of $cm^2$.

In a preferred method of formation, the patterning of electrode interconnections between microcavities occurs automatically during the course of wet chemical processing (anodization) of a metal electrode. Prior to processing, microcavities (such as through holes) of the desired shape are produced in a thin metal electrode (e.g., a foil or film). In preferred embodiments, fabrication is controlled so as to reduce stress in the array induced during fabrication. Preferably, the anodization proceeds symmetrically. Stress reduction structures may also be formed in the thin metal electrode prior to processing. The electrode is subsequently anodized, symmetrically and uniformly, so as to convert metal into dielectric (normally an oxide). The preferred symmetrical and uniform anodization process and microcavity placement determines whether adjacent microcavities in an array are electrically connected or not, and promotes the fabrication of a low stress array.

Relative to previous microcavity plasma technologies, this invention has several advantages. One is that the capacitance of the two electrode structure is reduced because the first electrodes and interconnections, if any, (and, in some preferred embodiments, the second electrode as well) are not in the form of a continuous sheet as has been the case with most previous technology. Much of the metal sheet that, in former microplasma devices and arrays, would constitute one electrode is converted in this invention into a metal oxide dielectric. Since the capacitance of a parallel plate capacitor is proportional to the electrode area, the reduction in electrode area similarly reduces the capacitance of the overall structure. The reduction in capacitance similarly reduces the displacement current of an array which renders this technology of value for display (and other) applications for which large displacement currents are generally a liability. Incorporation of stress reduction geometries or structures permits high resolution, low stress large arrays that maintain flatness over large surface areas.

Another advantage of embodiments of the present invention is that the dielectric can be a material with a large bandgap and, hence, is transparent in the visible and, perhaps, in portions of the ultraviolet (UV) or infrared (IR) regions as well.

With preferred formation methods, the buried circumferential thin metal electrodes form as self-patterned electrodes. The self-patterned electrodes can provide for the delivery of electrical power to, and interconnections among, microcavity plasma devices. Circumferential electrodes are buried in a metal oxide dielectric and surround each microcavity. The shape of the circumferential electrode surrounding a microcavity essentially replicates the cross-sectional geometry of the microcavity (circular, diamond, etc.)—that is, the electrode shape essentially matches that of a cross-section of the microcavity. A thin film of the metal oxide dielectric lies between the electrode and the wall of the microcavity, thereby electrically insulating the electrode and providing chemical and physical isolation of the electrode from the plasma produced within the microcavity when a gas/vapor is present in the microcavity and the proper voltage is applied to the two electrodes. In embodiments of the invention, the electrodes associated with different microcavities can be interconnected in patterns that are controllable. In the preferred method of formation, the patterning of electrode interconnections between microcavities occurs automatically during the course of symmetrical and uniform wet chemical processing (anodization) of a metal foil or film. Prior to processing, microcavities of the desired shape are produced in a thin metal foil or film. Furthermore, preferred embodiment arrays have microcavities of differing cross-sections in the same array. In preferred embodiments, stress reduction geometries or structures, e.g., support ribs, blocking ribs, or trenches, are also defined or formed prior to processing. The foil or film is subsequently anodized to convert substantially all of the metal into a dielectric (normally an oxide). The anodization process and microcavity placement determine whether adjacent microcavities in an array are electrically connected or not.

A fabrication method of the invention is a symmetrical wet chemical process in which self-patterned circumferential electrodes are automatically formed around microcavities during this process which converts metal to metal oxide. The size (cross-sectional dimensions) and pitch of the microcavities in a metal foil (or film) prior to anodization, as well as the anodization parameters, determine which of the microcavity plasma devices in a one or two-dimensional array are connected. In a preferred embodiment, a thin metal foil is obtained or fabricated with microcavities having any of a broad range of cross-sections (circular, square, etc.). In preferred embodiments, the array that is formed includes one or more stress reduction structures. The foil is symmetrically anodized to form metal oxide. One or more self-patterned metal electrodes are automatically formed and simultaneously buried in the metal oxide created by the symmetrical anodization process. The electrodes form uniformly around the perimeter of each microcavity, and can be isolated or connected in patterns. The geometry of the oxide and/or the inclusion of support structures results in reduced stress in the overall array despite different coefficients of thermal expansion for the metal and the metal oxide. The shape of the electrodes that form around the microcavities is dependent upon the shape of the microcavities prior to anodization to create the metal oxide. Thus, for example, cylindrical microcavities produce buried ring-shaped electrodes and diamond-shaped microcavities produce diamond-shaped buried electrodes. The electrode around each microcavity is, however, not flush with the microcavity wall. Rather, the electrode is covered by metal-oxide, a portion of which forms the wall of the microcavity.

Preferred embodiment fabrication methods are readily controlled by the parameters of the symmetrical anodization process to, for example, connect groups of microcavities. Electrodes can be formed so as to ignite an entire group of microcavity plasma devices (such as a row or column of devices in a two dimensional array) or, if desired, a single device in an array. The formation of the self-patterned electrodes and the conversion of metal foil to metal oxide can be accomplished entirely in an acid bath. One way to produce an array of devices is to bond a thin oxide layer having patterned buried electrodes and microcavities to a second thin oxide layer also having buried electrode(s). Fabrication methods of the invention are inexpensive and permit large sheets of material to be processed simultaneously. Addressable and nonaddressable arrays can be formed.

Devices of the invention are amenable to mass production techniques which may include, for example, roll-to-roll processing for the purpose of bonding the first and second thin layers, each of which has buried electrodes. Embodiments of the invention provide for large arrays of microcavity plasma devices that can be made inexpensively. Also, exemplary devices of the invention are flexible and at least partially transparent in the visible region of the spectrum.

The structure of preferred embodiment microcavity plasma devices of the invention is based upon thin foils (or films) of metal that are available or can be produced in arbitrary lengths, such as on rolls. In a method of the invention, a pattern of microcavities is produced in a metal foil which is subsequently symmetrically anodized, thereby resulting in microcavities in a metal-oxide (rather than the metal) with each microcavity surrounded (in a plane transverse to the microcavity axis) by a buried metal electrode. The geometry of the oxide and/or the inclusion of stress reduction structures results in low stress despite different coefficients of thermal expansion for the metal and the metal oxide. During device operation, the metal oxide protects the microcavity and electrically isolates the electrodes. Furthermore, some stress reduction structures of the invention can be fabricated in the metal foil during the same step in which the microcavities are formed.

A second metal foil is also encapsulated with oxide and can be bonded to the first encapsulated foil. The second metal foil forms a second electrode(s), which also preferably incorporates stress reduction structures. For one preferred embodiment microcavity plasma device array of the invention, no particular alignment is necessary during bonding of the two encapsulated foils. In another embodiment of the invention, the second electrode comprises an array of parallel metal lines buried in the metal-oxide. The entire array, comprising two metal-oxide layers with buried electrodes, can be sealed by thin glass or quartz plates, or even plastic windows, for example, with the desired gas or gas mixture sealed within.

Preferred materials for the thin metal electrodes and metal oxide are aluminum and aluminum oxide ($Al/Al_2O_3$). Another exemplary metal/metal oxide material system is titanium and titanium dioxide ($Ti/TiO_2$). Other metal/metal oxide material systems will be apparent to artisans. Preferred material systems permit the formation of microcavity plasma device arrays of the invention by inexpensive, mass production techniques such as roll-to-roll processing.

The shape (cross-section and depth) of the microcavity, as well as the identity of the gas or vapor in the microcavity, the applied voltage and the voltage waveform, determine the plasma configuration and the radiative efficiency of a microplasma, given a specific atomic or molecular emitter. The overall thickness of exemplary microplasma array structures of the invention can be, for example, 200 μm or less, making such arrays very flexible and inexpensive. Furthermore, the density of microcavity plasma devices (number per $cm^2$ of array surface area) can exceed $10^4$ $cm^{-2}$, with filling factors (ratio of the array's radiating area to its overall area) beyond 50% attainable.

Embodiments of the invention provide independent addressing of individual microcavity plasma devices in an array. As noted above, in one embodiment the second electrode comprises one or more arrays of parallel metal lines buried in metal oxide. The entire addressable array includes two electrodes or electrode patterns, separately buried in metal oxide by anodization and subsequently bonded.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize broader aspects of the invention. Various single microplasma device and array configurations of preferred embodiments will be discussed with respect to FIGS. 1-8 and 18, and various preferred stress reduction geometries, structures and fabrication methods that can be used with the array configurations of FIGS. 1-8 and 18, will be discussed with respect to FIGS. 9-17.

FIG. 1 is a cross-sectional diagram of an example embodiment of microcavity plasma device array 10 of the invention. Microcavities 12 are defined in a first thin metal oxide layer 15 that includes buried first circumferential electrode(s) 16. The metal oxide 15 protects the first circumferential electrodes 16 from the plasma produced within the microcavities, thereby promoting the lifetime of the array 10, and electrically insulating the circumferential electrodes 16 as well.

Notice that circumferential electrodes 16, as shown in cross-section in FIG. 1, are tapered. That is, the thickness of the electrode is the largest in proximity to a microcavity but decreases away from the microcavity. Although not evident in FIG. 1, each circumferential electrode 16 surrounds each respective microcavity and is azimuthally symmetric. Another feature of this embodiment is that a thin layer of metal-oxide dielectric exists between the inner edge of electrode 16 and the wall of the microcavity 12. The array 10 includes a stress reduction structure or geometry, as discussed below with respect to FIGS. 9-17.

A second electrode 18 in FIG. 1 can be a solid thin conductive foil and is buried within a second thin oxide layer 19, e.g., a metal oxide similar to that of the first layer 15. However, in preferred embodiments, the second electrode 18 is patterned as, for example, parallel lines aligned with the rows (and/or columns) of microcavities 12. In one embodiment, the metal lines comprising second electrode 18 are connected electrically. In this way, a common electrode can be formed as an array over a large area, but the amount of metal is reduced compared to a solid thin conductive foil and the capacitance of the overall device array is thus reduced. In other embodiments, the metal lines may not be connected electrically for the purpose of addressing individual microcavity devices. The second electrode 18 is buried in or encapsulated by oxide 19. A discharge medium (gas, vapor, or combination thereof) is contained in the microcavities 12 and microplasmas are produced within the microcavities 12 when a time-varying voltage waveform having the proper RMS value is supplied by generator 22. The driving voltage may be sinusoidal, bipolar DC, or unipolar DC, for example.

The array 10 can be sealed by any suitable material, which can be completely transparent to emission wavelengths produced by the microplasmas or can, for example, filter the output wavelengths of the microcavity plasma device array 10 so as to transmit radiation only in specific spectral regions. The array 10 includes a transparent layer 20, such as a thin glass, quartz, or plastic layer. The pressure of the discharge medium can be maintained at or near atmospheric pressure, permitting the use of a very thin glass or plastic layer because of the small pressure differential across the sealing layer 20. Polymeric vacuum packaging, such as that used in the food industry to seal various food items, may also be used in which case the layer 20 will extend past the edge of 15 and would be sealed to another layer of the same material enclosing array 10 from the bottom.

It is within each microcavity 12 that a plasma (discharge) will be produced. The first and second electrodes 16, 18 are spaced apart a distance from each other by the sum of the respective thicknesses of their oxide layers. The oxide thereby isolates the first and second electrodes 16, 18 from one another and, additionally, isolates each electrode from the discharge medium (plasma) contained in the microcavities 12. This arrangement permits the application of a time-varying (AC, RF, bipolar or pulsed DC, etc.) potential between the electrodes 16, 18 to excite the gaseous or vapor medium so as to create a microplasma in each microcavity 12.

Figure 2A:
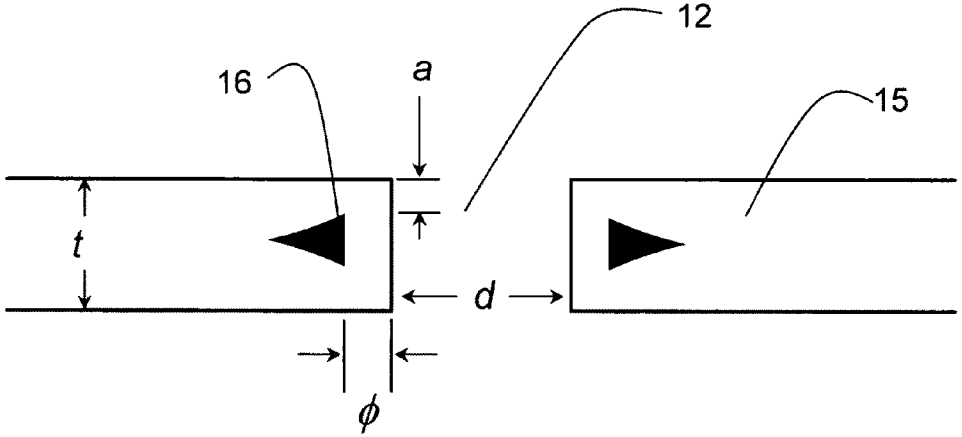
FIG. 2A is a schematic cross-sectional view of an individual microcavity and its associated buried circumferential electrode in cross-section.
Figure 2B:
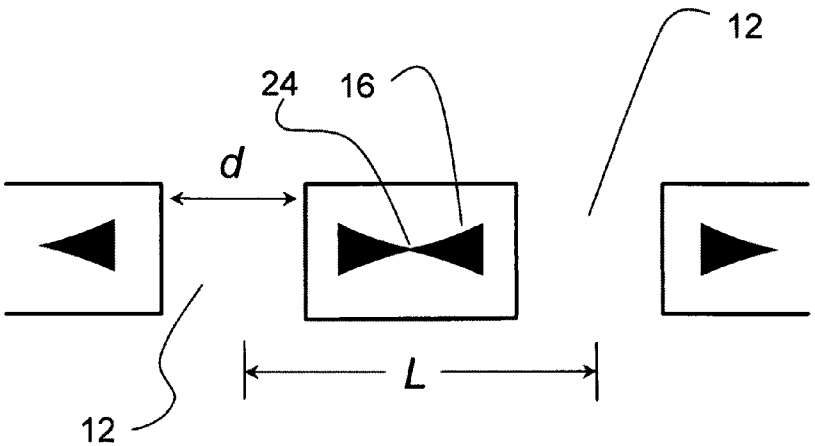
FIG. 2B is a schematic cross-sectional view of a portion of a microcavity array having interconnected buried circumferential electrodes.

FIG. 2A shows an individual microcavity 12 and buried circumferential electrode 16 in cross-section, and FIG. 2B shows two adjacent microcavities 12 with circumferential electrodes 16 and interconnections 24. The interconnections 24 are continuous with the circumferential electrodes 16 that they connect, being formed by the merger of two circumferential electrodes 16.

Figure 3:
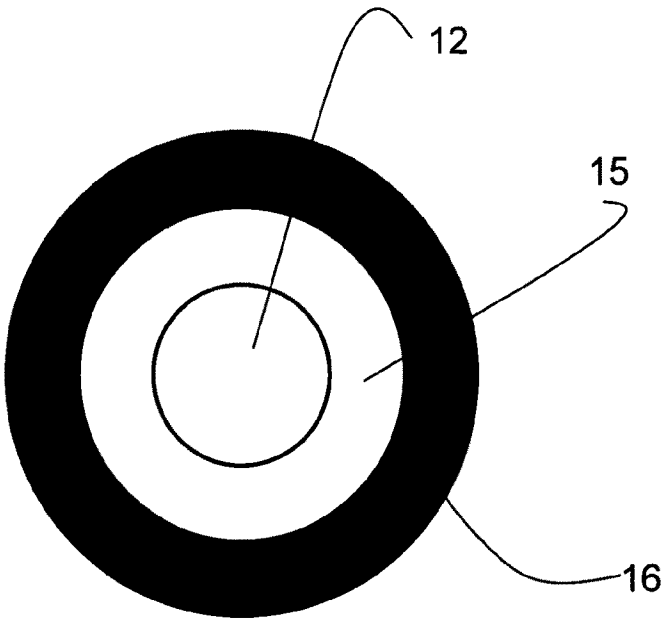
FIG. 3 shows a schematic top view of an individual microcavity and buried circumferential electrode of FIG. 2.

FIG. 3 is a top view of an individual cylindrical microcavity and buried electrode 16 showing that the buried electrode 16 forms a ring around the microcavity. During formation according to a preferred method, the self-patterned buried circumferential electrodes form automatically around each microcavity, and can be connected in patterns or isolated. As seen in FIGS. 2A, 2B and 3, the electrode 16 is formed such that a layer of metal-oxide dielectric 15 having a thickness $\phi$ exists between the inner edge of electrode 16 and the microcavity wall. Similarly, the thickness of the metal oxide between the top edge of electrode 16 and the upper surface of dielectric layer 15 is a, the total thickness of layer 15 is defined as t, and the diameter of the microcavity is d. In preferred embodiments, $\phi$ typically is in the 1-30 μm range and a is in the 5-40 μm interval. If a is larger than $\phi$, the plasma is generally confined within microcavity 12. While the example embodiment illustrates cylindrical microcavities, self-patterned formation processes of the invention can be used to form microcavities having arbitrary cross-sections (rectangular, diamond, etc.), each microcavity having its own self-patterned buried circumferential electrode.

In a preferred formation process of the invention, a thin metal foil having a pattern of microcavities (with the desired cross-sectional geometry) already present, is obtained. The microcavities may extend partially or completely through the metal foil (the latter is illustrated in FIGS. 1, 2A and 2B). A metal foil can have a pattern of microcavities (such as through holes) produced in it by any of a variety of techniques, including microdrilling, laser micromachining, chemical etching, or mechanical punching. Foils with pre-formed microcavities in the form of through holes of various shapes are available commercially.

The next step is to convert much of the metal foil into metal oxide by a symmetrical anodization process. This process is controlled so as to result in self-patterned first electrodes (see FIGS. 1-3) which surround each microcavity. These metal rings around each microcavity, buried in metal oxide, can be connected in various patterns or a single interconnected electrode may be formed, if desired. Through control of the parameters of the anodization process (molar concentration, temperature, process times, etc.), the dimensions of the buried electrodes and interconnections (if any) can be varied and specified.

The method of formation is suitable for large scale processing and is inexpensive. Buried, self-patterned electrodes are formed automatically by symmetrical anodization, a wet chemical process. Consequently, the process is inexpensive and ideally suited for processing large areas. Producing electrodes for an array by thin film deposition techniques is comparatively expensive. Therefore, while minimizing the equivalent capacitance of a light-emitting array is important to its high-frequency electrical characteristics (such as switching time), patterning the electrode by conventional deposition processes raises the cost of the array and the complexity of the fabrication process. With the formation method of the invention, the electrode area can be reduced dramatically without adding complexity to the fabrication process.

FIG. 2A shows a diagram of a single microcavity and parameters related to interconnection of buried metal electrodes between microcavities. A cross-sectional diagram of two interconnected microcavities is given in FIG. 2B. For the parameters of FIG. 2B, a buried electrode associated with one microcavity is automatically connected with the electrode of another microcavity by controlling the spacing (pitch) L, between the microcavities. If L is smaller than the microcavity diameter d, the electrodes are interconnected to one another.

Figure 4:
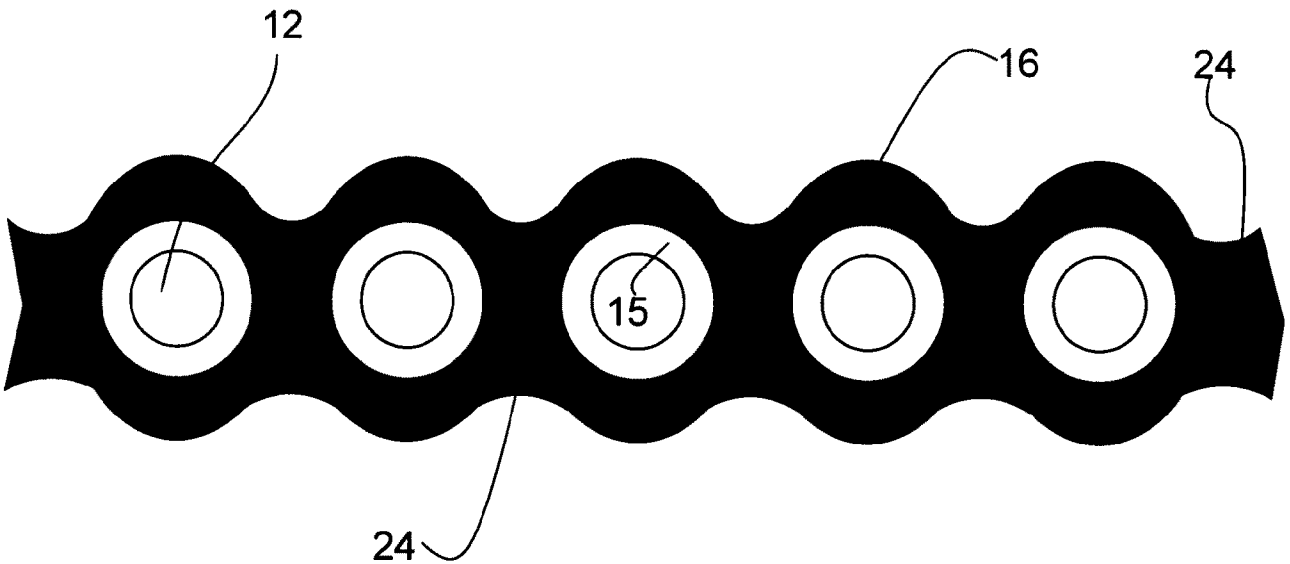
FIG. 4 is a schematic top view of a plurality of microcavities interconnected by buried circumferential electrodes.

Prototype arrays according to exemplary embodiments of the invention have been fabricated and tested. Specifically, linear arrays of microcavity plasma devices have been realized by anodizing in oxalic acid an aluminum foil into which a pattern of cylindrical microcavities (in the form of through holes) had previously been formed. For these exemplary arrays, the thickness of the Al foil is 127 μm, and the diameter and pitch (center-to-center spacing) of the circular holes are 250 μm and 200 μm, respectively. Anodizing the foil in a 0.3 M solution of oxalic acid at 25° C. for 7 hours converts most of the aluminum foil to aluminum oxide ($Al_2O_3$) but leaves behind a patterned, thin layer of Al that is buried in $Al_2O_3$ (as shown in FIG. 2 and FIG. 4). This patterned thin layer of Al is well-suited as an electrode to produce microplasmas in the cavities 12 of FIGS. 1 and 4. Stated another way, the anodization process selectively converts Al into $Al_2O_3$ such that, if the anodization process is terminated at the appropriate time, the remaining Al will serve as an electrode(s) for individual microplasma devices in an array, or as an electrode(s) interconnecting some or all of the microcavities in a microcavity plasma device array.

The ring structure of the circumferential electrodes formed by this process, shown in cross-section in FIGS. 1, 2A and 2B, is the result of the dynamics of the anodization process near a microcavity in a metal foil or film. Some distance away from the microcavity, anodization of a foil immersed in the anodization bath proceeds uniformly on each side of the foil, e.g., an Al foil, resulting in a thin Al sheet (whose thickness decreases with anodization time) encapsulated in a transparent $Al_2O_3$ film whose thickness increases with processing time. Near the microcavity, however, the process proceeds differently because acid within the hole is also participating in anodization. Therefore, in the vicinity of the perimeter of the microcavity, anodization is moving inward from both sides of the foil but, at the same time, it is also proceeding outward, away from the microcavity. However, the conversion of Al into $Al_2O_3$ is slower within the microcavities than outside (i.e., on the surface) because the flow of fresh acid into the small diameter channel (microcavity) is restricted. The result is that the cross-section of the Al electrode (FIG. 2A) is flared near the microcavity and an $Al_2O_3$ layer of thickness $\phi$ now lines the microcavity. Also, the inner surface of the electrode—the surface facing the microcavity—is essentially parallel to the microcavity wall. Thus, this process forms a ring electrode that is essentially equidistant from the microcavity wall. Furthermore, in the vicinity of the microcavity, the electrode cross-section has the form of an arrowhead or triangular shape.

The buried circumferential electrodes form automatically during the anodization process as a result of the flow of oxalic acid into the microcavities. The arrowhead cross-sectional shape of the metal electrodes that surround the microcavities 12 (see, e.g., FIGS. 1, 2A and 2B) is produced by the nonuniform reaction rate for anodization near the microcavity. Away from the microcavity, the conversion of the metal foil into metal oxide can proceed to near completion (if desired), but, close to the microcavity, more metal remains because the reaction rate falls near the microcavity owing to the restricted movement of acid into the microcavity (as well as the slow removal of the chemical products of anodization from the microcavity). The result of this process is that self-patterned electrodes, buried in metal oxide, are formed (or, more precisely, left by the anodization process) around the microcavities. It should be emphasized that these formed structures can be modified into various geometries with the implementation of a patterning process or selective anodization techniques (such as those facilitated by masking).

In FIG. 4, buried circumferential electrodes 16 surrounding each microcavity 12 include interconnections 24 to form a single continuous electrode for the linear array of microcavities 12 shown in FIG. 4. In a preferred embodiment, interconnections 24 are the result of the non-separation (or merged nature) of adjacent circumferential electrodes 16 around individual microcavities, which can be used to connect both small and large groups of microcavities 12 to form, for example, addressable microcavity plasma device arrays. As described above with respect to preferred formation processes, microcavity spacing and the duration and conditions of the anodizing process can leave interconnections 24 as continuous with adjacent electrodes 16 or, if preferred, the electrical connections between adjacent devices may be severed if the anodization process is allowed to proceed sufficiently far.

Figure 5:
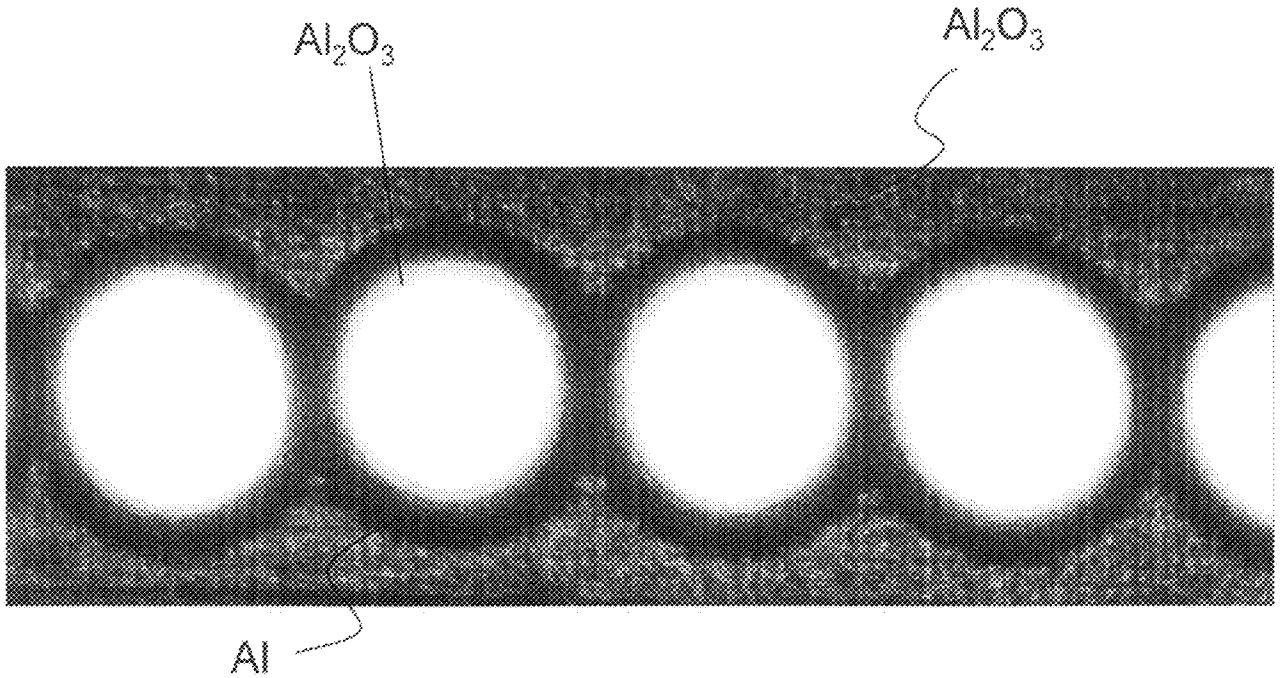
FIG. 5 is a photograph showing a portion of a linear array of 250 μm dia. cylindrical microcavities in $Al_2O_3$ with buried circumferential Al electrodes that are interconnected.

Experiments have also demonstrated that self-patterned, buried electrodes can be formed to electrically connect arrays of microcavities. A portion of a linear $Al/Al_2O_3$ array of 250 μm dia. interconnected microcavities is shown in FIG. 5. This photograph, taken from above, shows that, away from the linear array, Al was essentially completely converted into $Al_2O_3$ which is transparent in the visible region. Also, the buried Al rings around each microcavity (which appear as white circles because the microcavity array is backlit in this photograph) are clearly evident. When operated with 400 Torr of Ne, for example, the arrays of FIG. 5 produce uniform glow discharges in each cavity. Operation at pressures up to approximately one atmosphere has been demonstrated to date and many gases (in addition to Ne) and vapors are well-suited for these microplasma device arrays.

Figure 6:
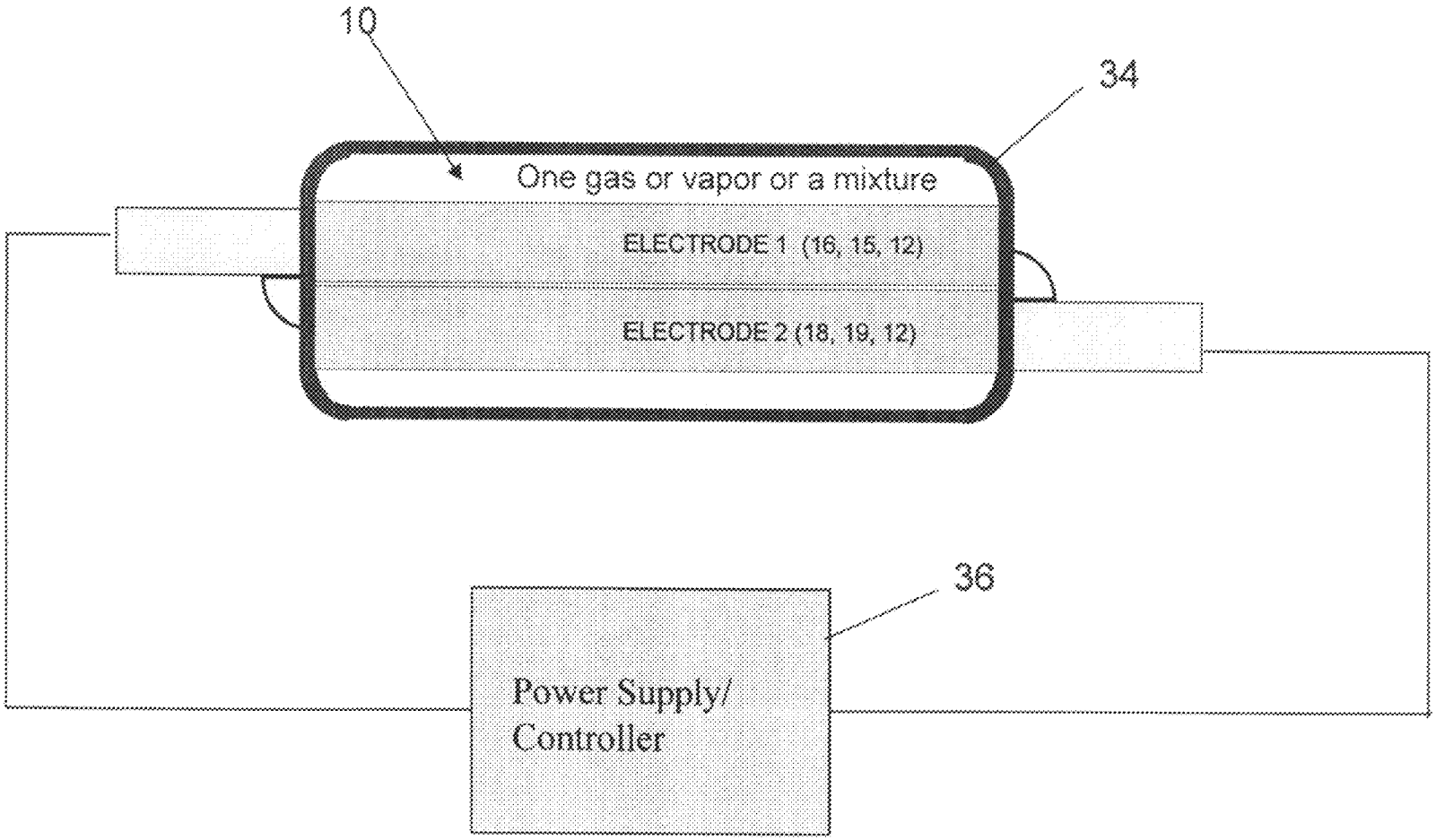
FIG. 6 is a schematic cross-sectional view of an exemplary embodiment array of microcavity plasma devices of the invention.

FIG. 6 is a diagram of a lamp incorporating an array of microcavity plasma devices of the invention. In the FIG. 6 array, first and second buried electrodes 16, 18 (one or both of which have microcavities 12), for example according to FIG. 1 or 4, are fabricated in metal and metal oxide, e.g., by anodizing pre-formed Al screens to yield a microcavity plasma device array 10 with buried circumferential electrodes, which can be sufficiently thin to be flexible. To maintain a high level of flexibility after vacuum sealing, the array 10 is packaged in polymeric vacuum packaging 34, such as that used by the food industry. Extensions of the electrodes 16, 18 are illustrated as extending beyond the packaging 34 for connection to a power supply/controller 36, while other techniques for connection will be apparent to artisans. Vacuum sealing in polymeric packaging is possible because the microcavity plasma device array 10 can be operated at or near atmospheric pressure, resulting in a small (if any) pressure differential between the inside and outside of the lamp. If necessary, the inner surface of the polymeric packaging may be coated with a thin, transparent diffusion barrier film. Such a film will inhibit the diffusion of molecules from the packaging into the plasma.

Figure 7A:
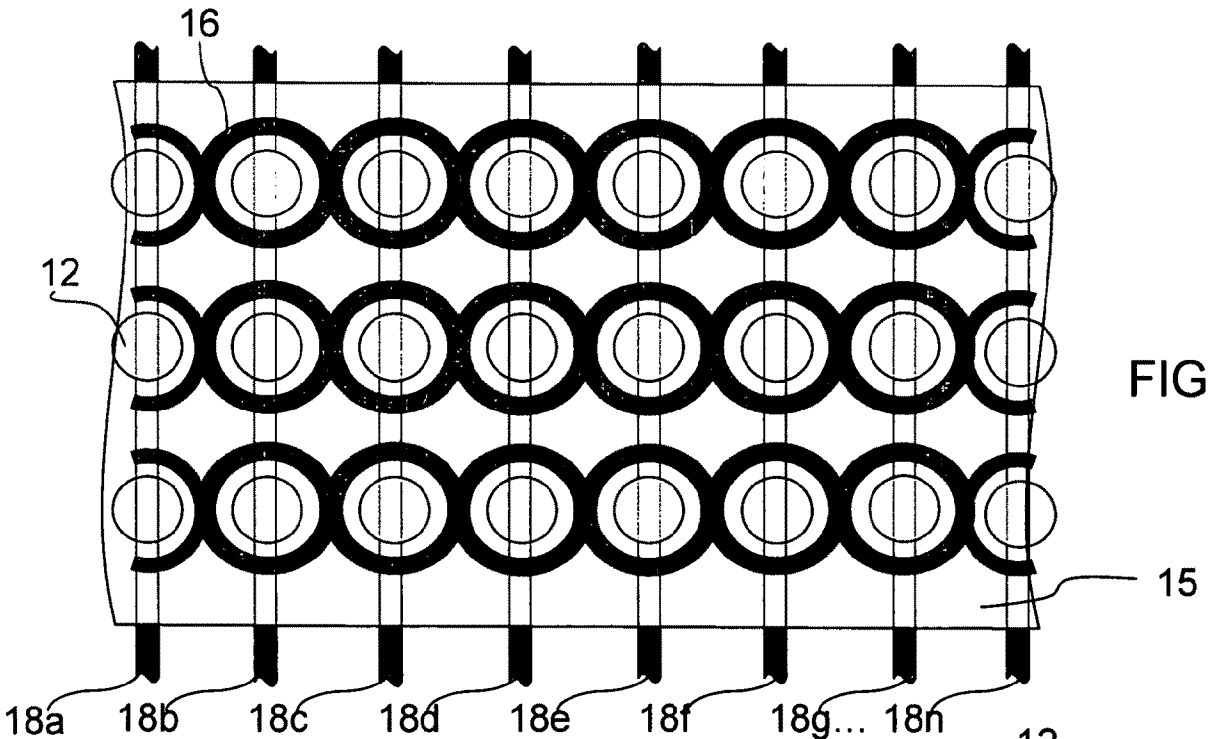
FIGS. 7A and 7B are schematic top and cross-sectional views, respectively, of a preferred embodiment of an addressable array of microcavity plasma devices of the invention.
Figure 7B:
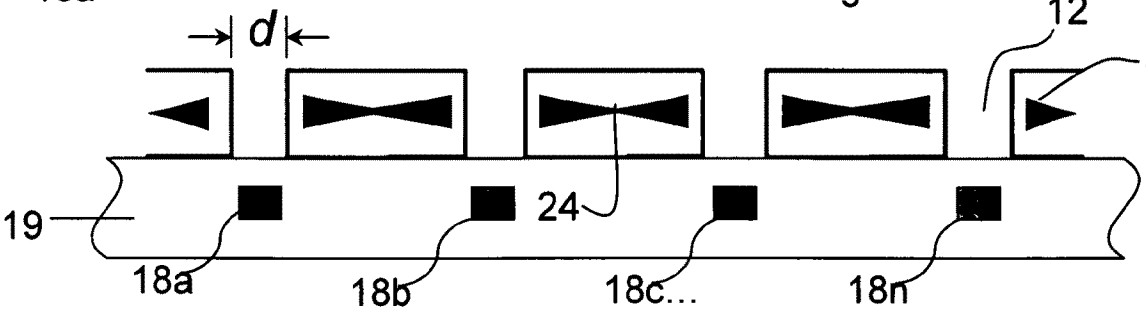

An addressable microcavity plasma device array embodiment of the invention is illustrated schematically in FIGS. 7A and 7B. In FIGS. 7A and 7B, reference numbers from previous figures are used to label comparable parts. The first electrodes 16 in FIGS. 7A and 7B are buried circumferential electrodes in the form of a ring around each microcavity. The electrodes 16 are buried in, and protected by, a first thin layer of oxide 15. Interconnections 24 connect linear arrays of electrodes 16. The second electrode 18 comprises parallel line electrodes 18*a*-18*n* buried in a thin oxide layer 19. By aligning line electrodes 18*a*-18*n* with rows and/or columns of microcavities 12 in the first thin layer of oxide 15, microcavity devices (or a linear array of such devices) are formed which are capable of being addressed individually.

Figure 8A:
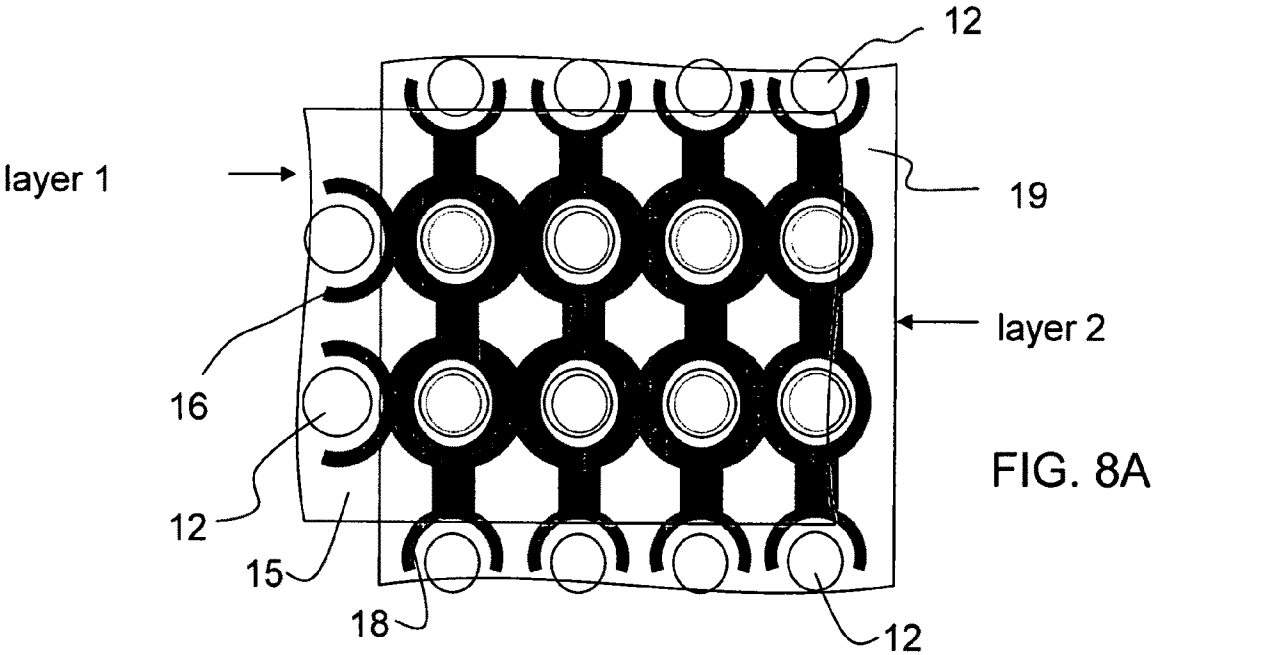
FIGS. 8A and 8B are schematic top and cross-sectional views, respectively, of another preferred embodiment of an array of addressable microcavity plasma devices of the invention.
Figure 8B:
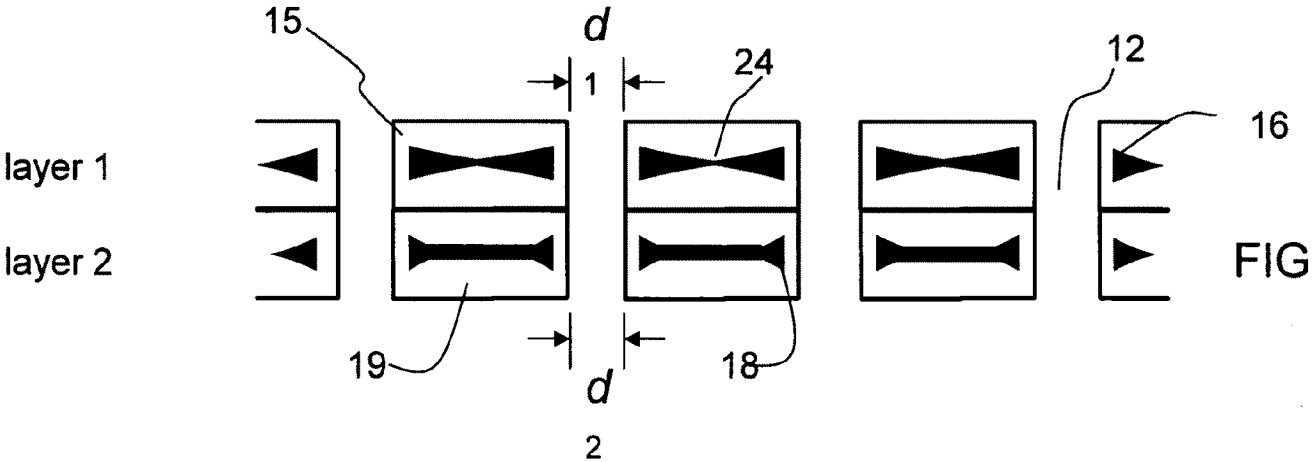

FIGS. 8A and 8B show another addressable microcavity plasma device array embodiment of the invention. In FIGS. 8A and 8B, reference numbers from earlier figures are used to label comparable parts. In FIGS. 8A and 8B, the first electrodes 16 and second electrodes 18 each comprise interconnected buried circumferential electrodes surrounding microcavities 12 formed in both of the thin oxide layers 15 and 19. The microcavities 12 in the oxide layer 19 can have different diameters than the microcavities 12 in the oxide layer 15, which can aid alignment between electrodes or be used to produce an optimized structure for a flat panel display system, for example.

In FIG. 8B, the electrodes 18 are seen to have a different shape than the buried circumferential electrodes 16. In preferred embodiment addressable arrays, rows are separated to avoid cross-talk. The second electrodes 18 in FIG. 8B, can also be formed by the preferred methods described above for the formation of buried circumferential electrodes. However, a subsequent patterning process (lithography) can be used to define row spacings, and for the extension of metal lines 26 connecting electrodes around microcavities 12.

Figure 9A:
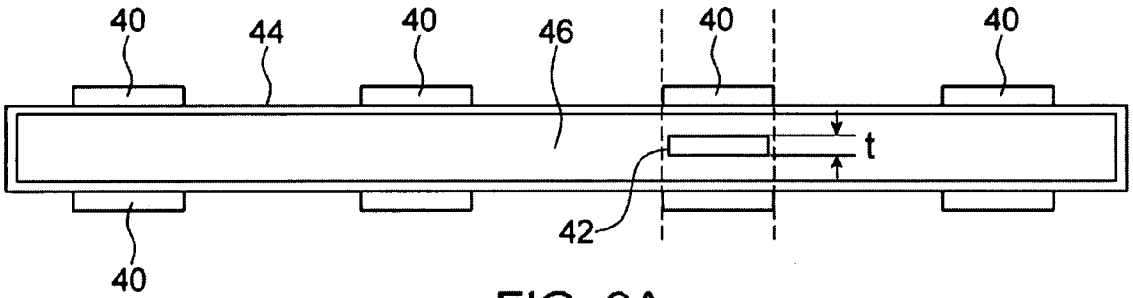
FIGS. 9A and 9B illustrate preferred embodiment patterned and common electrodes and formation methods for producing patterned and common electrodes, respectively, having a low mechanical stress geometry that can be used for low stress array of microcavity plasma devices of the invention or other devices.
Figure 9B:
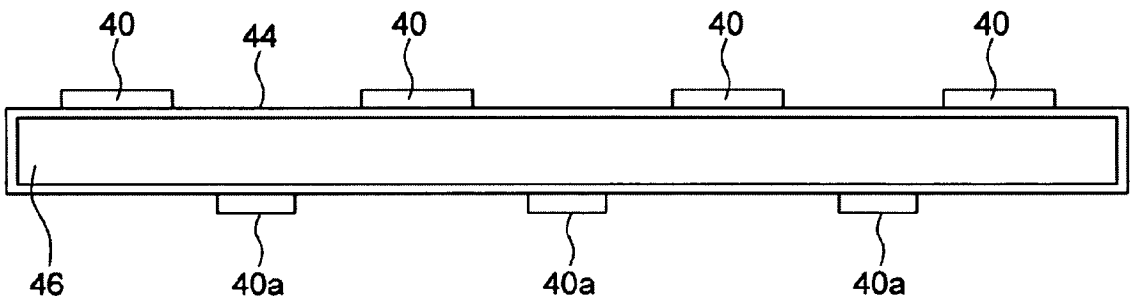

Stress reduction can be incorporated into any of the FIGS. 1-8B embodiments. FIGS. 9A and 9B illustrate preferred embodiment patterned and common electrodes and formation methods for producing patterned and common electrodes, respectively, having a geometry for a low stress microcavity plasma device array of the invention. The processes in FIGS. 9A and 9B produce a metal/oxide geometry that reduces stress in the array.

In FIGS. 9A and 9B, support ribs 40, 40*a* are used to control the anodization process that converts metal to metal oxide. In FIG. 9A, the blocking support ribs 40), which can be formed from common photoresist, are aligned with the desired position of an electrode 42 that will result after full anodization. The support ribs 40 are formed after a thin (~5 μm) layer of metal oxide 44 is first grown on a metal foil 46. The presence of the thin metal oxide 44 simplifies handling of the metal foil 46. The FIG. 9A process results in parallel lines of electrodes buried in oxide, which can be aligned and bonded to a microcavity array to form an array of microcavity plasma devices. The blocking layers 40 in FIG. 9A serve not only to define the position of the buried metal electrode after anodization is concluded but also provide the support of the metal foil 46 to prevent buckling of the foil during the anodization process.

FIG. 9B illustrates the position of support ribs 40, 40*a* when fabricating a common electrode. Support ribs 40, 40*a* are formed on both sides of the foil but the widths of ribs 40*a* on the bottom (or back) side of the foil 46 should be smaller than those for the ribs on the top surface. Also, the ribs 40*a* on the back side are interlaced with the ribs 40 on the front surface. Ideally, the ribs 40*a* should be centered on the gaps between ribs 40 at the top of FIG. 9B.

FIGS. 9A-9B assume that the process begins with a metal film 46 that has no preformed microcavities. Support ribs 40, 40*a* are deposited onto the oxide 44 in a pattern, using photoresist or another convenient barrier material. First encapsulating the foil in alumina layers ~5 μm in thickness has worked well to date on experimental prototypes. The support ribs 40 are deposited onto the surface at approximately the horizontal position where a buried electrode 42 will form after the anodization process is completed in FIG. 9A. The support ribs 40 on the top and bottom of the FIG. 9A structure should be well aligned vertically. Common photoresist is a convenient and effective material for the support ribs 40, 40*a*, and is readily formed in the necessary aligned patterns by common photolithography techniques. FIG. 9B illustrates an exemplary design for a common electrode. In FIG. 9B, support ribs 40, 40*a* are deposited on both sides of a partially-anodized metal foil 46 but the ribs 40*a* are not as wide as the ribs 40. Furthermore, instead of being vertically aligned, the ribs 40, 40*a* are staggered or interlaced.

Figure 10A:
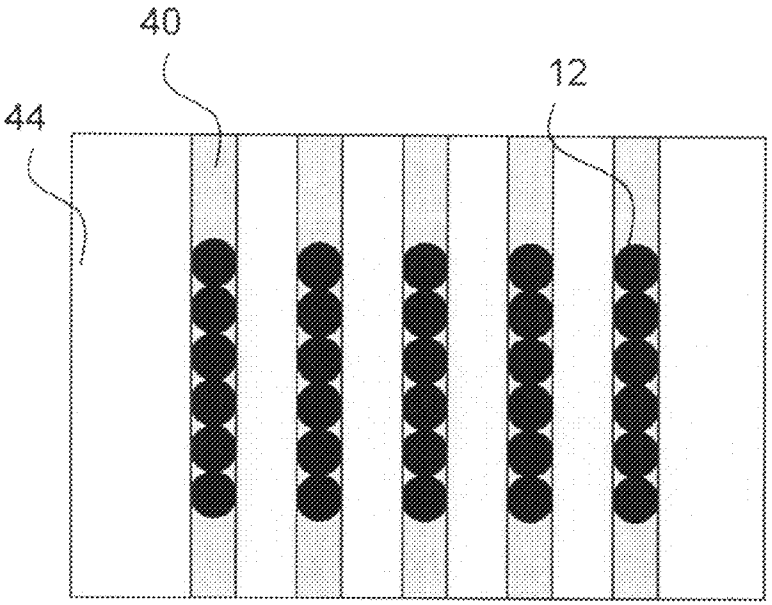
FIGS. 10A and 10B illustrate a preferred embodiment formation method for producing a microcavity array with support ribs so as to yield a low stress array of microcavity plasma devices of the invention.
Figure 10B:
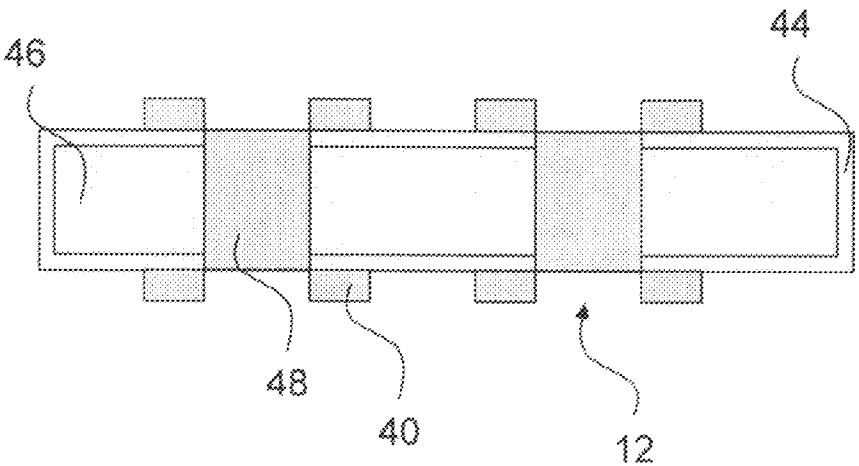

FIGS. 10A and 10B illustrate a preferred embodiment formation method for producing a microcavity array of the invention with buried circumferential electrodes having a low stress geometry. Support ribs 40 are located on either side of microcavities 12 and additional resist material 48 completely or partially fills microcavities 12. It is important to deposit support ribs 40 along the entire length of the microplasma device array and fill the microcavities themselves with resist 48, such as photoresist (PR) as shown. The resist 48 is removed after substantial anodization that converts most of the metal foil 46 to oxide. The resist 48 is removed for final anodization to permit conversion of the microcavity walls to oxide. Experiments have shown that taking these steps significantly reduces stress on the array during the anodization process, thereby yielding an array with superior flatness characteristics. For the processes of FIGS. 9A-10B, fabrication with aluminum foil to produce an aluminum/aluminum oxide array is the preferred materials system, but other metals and their oxides can be used. The primary function of the support ribs 40 is to provide structural support to reduce stress in the resulting array.

Figure 11:
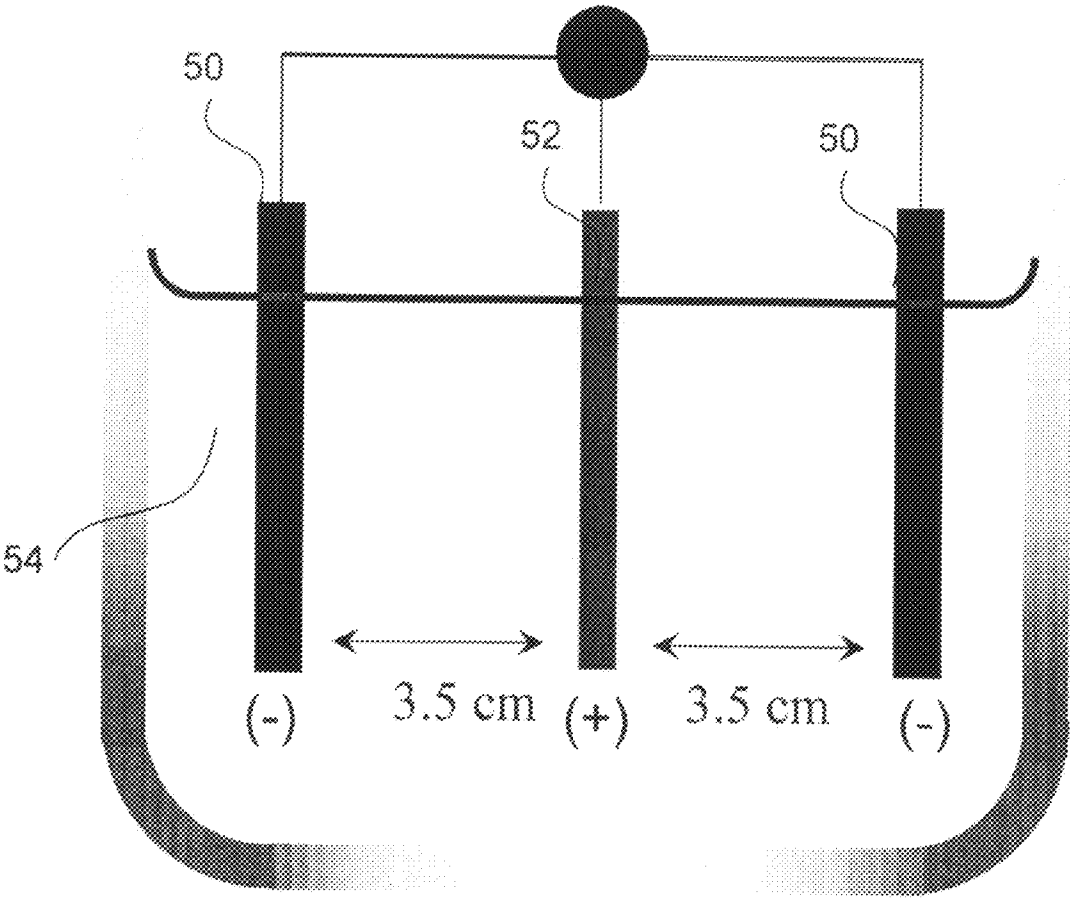
FIG. 11 illustrates a preferred embodiment symmetrical anodization process for producing low stress arrays of microcavity plasma devices of the invention.

Another important step in minimizing stress in the arrays during fabrication is to ensure that the anodization process is both symmetrical and uniform. FIG. 11 is a simplified diagram of the electrochemical anodization process by which metal oxide (e.g., $Al_2O_3$) is grown from metal foil (e.g., Al). The process uses two cathodes 50 spaced evenly apart from a metal foil 52 to be anodized in anodizing solution 54 to achieve anodization of the metal foil anode 52 in a symmetrical fashion, thereby dramatically reducing tension in the finished electrode, as compared to anodization using a single cathode.

Figures 12A, 12B, 12C, 12D:
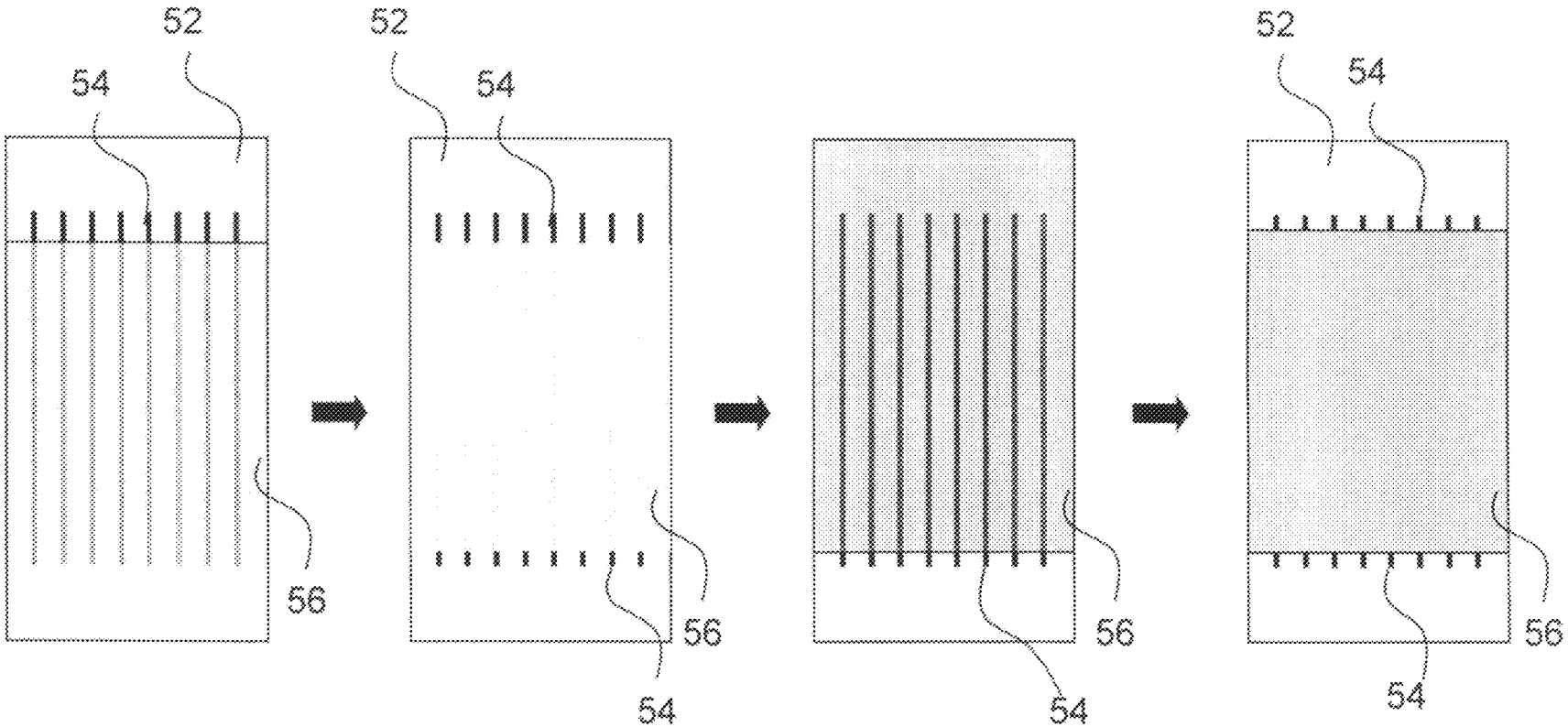
FIGS. 12A-12D illustrates a preferred embodiment symmetrical anodization process for producing low stress electrode layers that can be used in arrays of microcavity plasma devices of the invention or in other devices.

FIGS. 12A-12D illustrate preferred embodiment low stress patterned electrode sheets and a four step process for periodically rotating a foil during the anodization process to form patterned electrode sheets. This process can achieve symmetrical and uniform anodization even with a single cathode but the double cathode arrangement of FIG. 11 is preferred. The process begins by anodizing, in the usual manner, a metal foil 52 onto which a pattern of lines 54 (or other features) has been formed, generally by photolithography (FIG. 12A) using patterned resist 56. The second step (FIG. 12B) entails removing the oxide 44 from the lower portion of the array as shown, thereby exposing the metal 52 foil and rendering the lower portion of the structure symmetrical with respect to the upper portion. The next two steps (FIGS. 12C and 12D) reverse the process by anodizing only the upper portion of the foil 52 and line pattern 54 (FIG. 12C). The result is that the foil has been anodized in a manner that is symmetrical with respect to both ends of the foil, yielding a low stress metal/metal oxide structure in which a parallel array of metal electrodes is buried in transparent metal oxide.

Experimental prototypes have demonstrated the advantages of using the fabrication techniques described above. A pattern of parallel Al electrodes (lines), buried in $Al_2O_3$ by the anodization process of FIG. 9A was formed. The parallel Al lines were clearly visible whereas the remainder of the foil was transformed by anodization into transparent $Al_2O_3$. The ends of the aluminum lines were exposed, as illustrated in FIG. 12D. The processes of FIGS. 9A and 9B combine standard photolithography with anodization to yield an inexpensive means of producing linear arrays of metal lines that are well-suited for addressing microcavity plasma arrays. Aluminum is ideal for this application because of its high electrical and thermal conductivity. Furthermore, the process leaves the Al interconnect lines buried in $Al_2O_3$ which protects the interconnects from chemical corrosion and erosion arising from potential exposure to the plasma. Silver is currently used in plasma TVs (PDPs) for interconnects (addressing lines) but Al is more than two orders of magnitude less expensive than Ag.

Stress reduction has a profound impact on the performance of $Al/Al_2O_3$ microplasma arrays. Prototypes have demonstrated the benefit of stress reduction processing and geometry. Low stress arrays are almost perfectly flat, and have improved pixel-to-pixel emission uniformity over areas of 25 $cm^2$ and more.

Figure 13A:
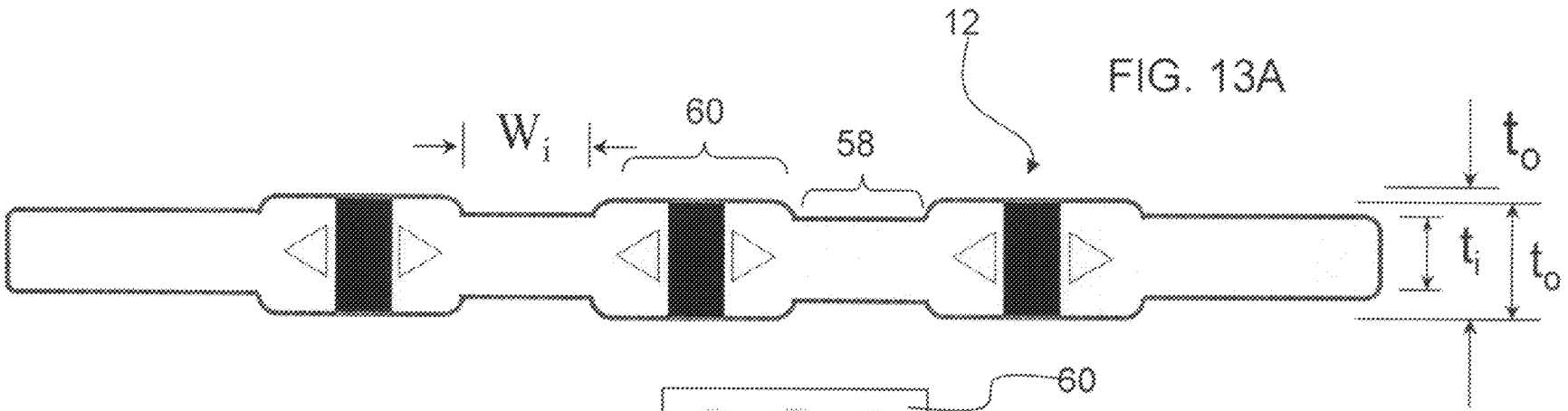
FIG. 13 illustrates a low stress microcavity array with buried circumferential electrodes.
Figure 13B:
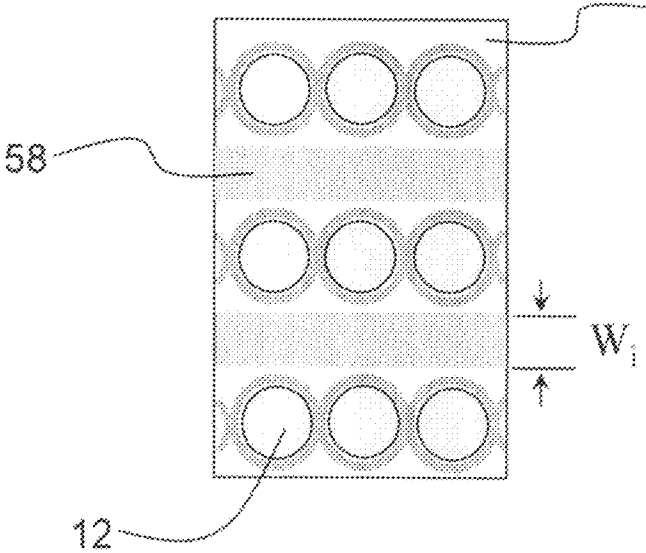
Figures 14A, 14B, 14C, 14D, 14E, 14F:
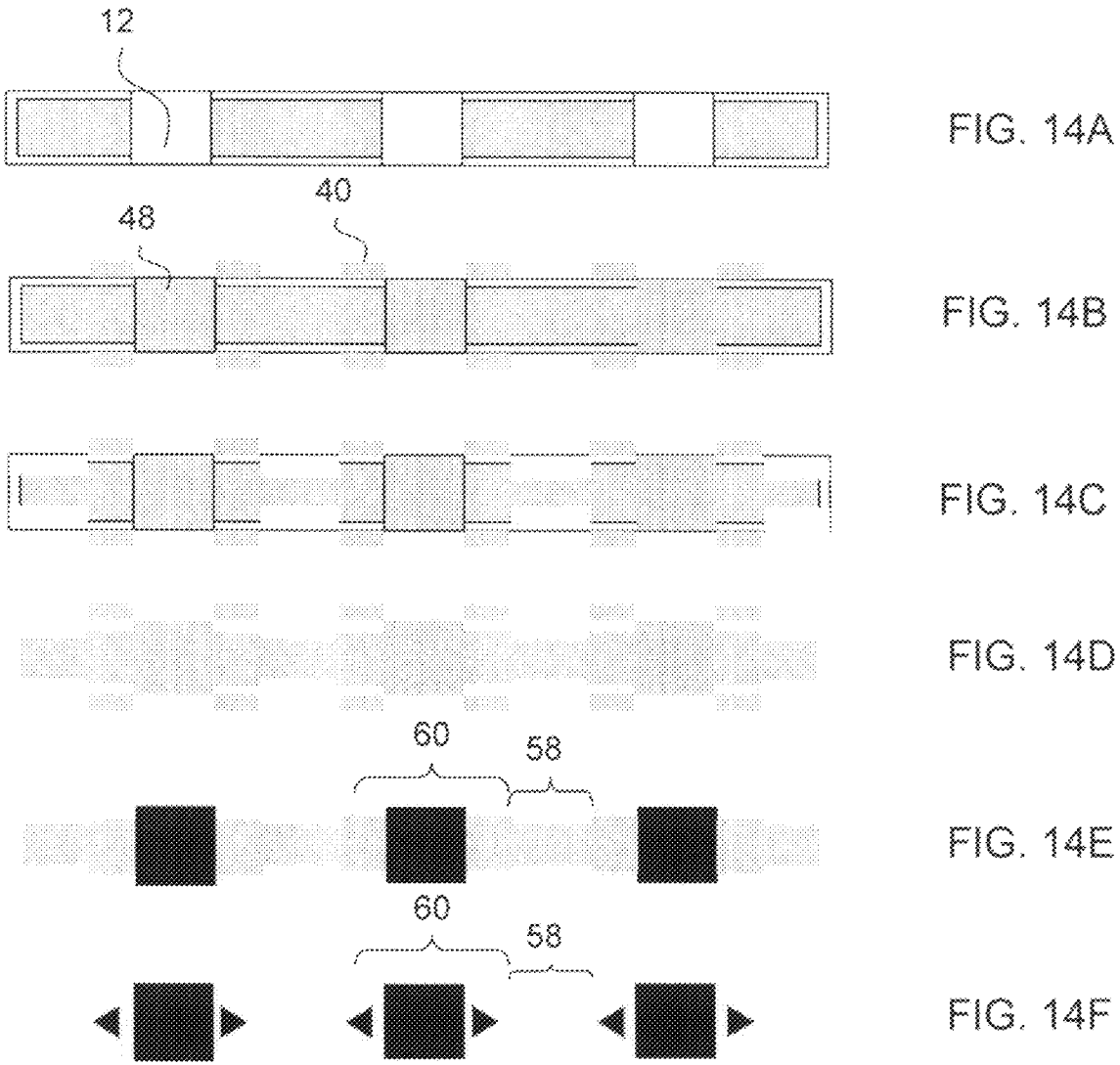
FIGS. 14A-14F illustrates a preferred embodiment anodization process for producing low stress microcavity plasma device arrays of the invention.

FIGS. 13A and 13B illustrate a low stress microcavity array with buried circumferential electrodes and a process for forming the array. This embodiment of the invention is based upon minimizing the volume of metal that must be transformed into metal oxide. This has two benefits, the first of which is to reduce the anodization time. The second benefit is the reduction in stress in the finished array. The structure of FIGS. 13A and 13B accomplishes both goals by limiting the fully anodized areas of the array in regions 58 between microcavities to a width denoted $W_i$ and a thickness denoted $t_i$, where $t_i$ is less than the thickness $t_o$ of the original metal foil. Other regions 60 are partially anodized and have a thickness approximating $t_o$. The structure of FIGS. 13A and 13B can be accomplished through the processing sequence of FIGS. 14A-14F in which the support ribs 40 of FIG. 10 are utilized to selectively remove metal from the foil in the regions 58 between the microcavities 12. In effect, the foil is being made thinner (except in the immediate vicinity of a microcavity) prior to final anodization. In FIG. 14A, the metal foil 52 with microcavities 12 is slightly anodized to form the thin oxide 44. In FIG. 14B, support ribs 40 of resist is deposited as well as additional resist 48 to coat or fill microcavities. In FIG. 14C, anodization occurs in regions 58 (but not regions 60, which are protected by resist). In FIG. 14D, some oxide is removed from the regions 58. In FIG. 14E, the resist is removed. In FIG. 14F, additional anodization occurs in all regions, including in microcavities 12, to complete the array. The result (shown in FIG. 14F) is an array of microcavities, each having an associated circumferential electrode 12, and a metal thickness near each microcavity 12 that is larger than that in the regions between the microcavities.

Figure 15:
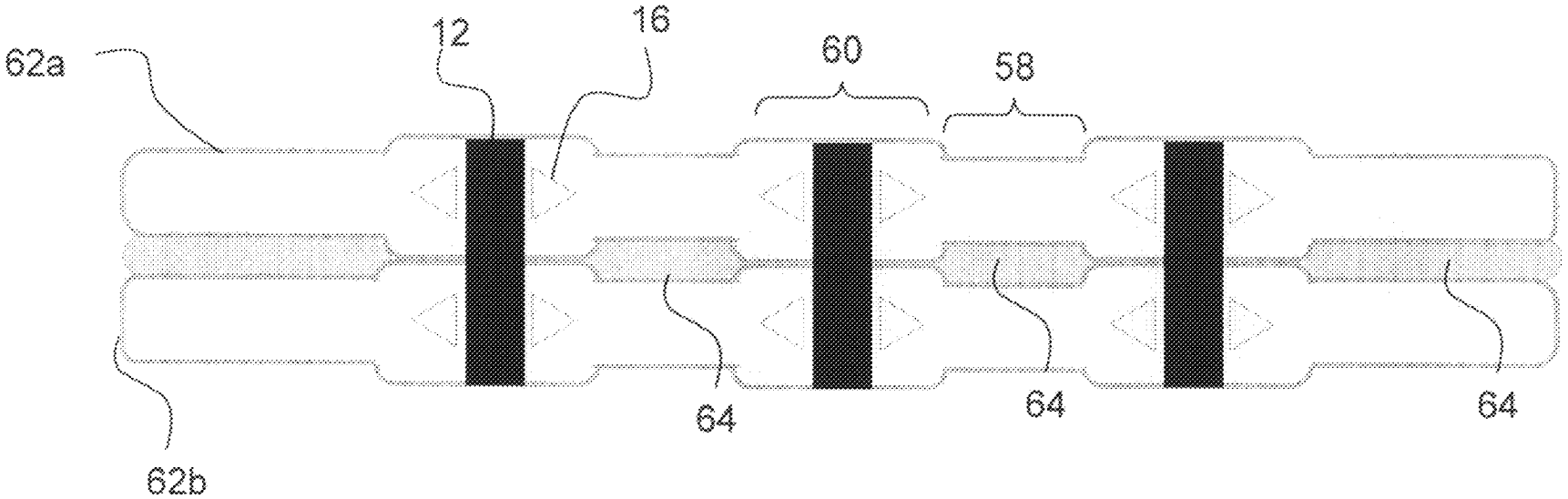
FIG. 15 is a schematic cross-sectional view of exemplary embodiment arrays of low stress microcavity plasma devices that includes two aligned and bonded arrays.

The electrode/microcavity assembly resulting from the process sequence of FIG. 14 can serve as one layer of a two layer microplasma array structure such as that shown in FIG. 15. In this embodiment of the invention, two sheets 62*a*, 62*b*, fabricated according to FIG. 14, are arranged and bonded by bonding agent 64 such that microcavities 12 are aligned as illustrated in FIG. 15. The bonding agent can be a sealing agent such as a glass frit. The electrodes 16 associated with each microcavity 12 enable addressing of the microcavities as would be desirable for a display. All of the electrodes 16 in the top sheet 62*a*, for example, could be part of a horizontal linear array that is oriented left-to-right whereas each of the lower electrodes 16 in the bottom sheet 62*b* could be a member of an array of separate addressing lines that are oriented orthogonal to the page.

Figures 16A, 16B:
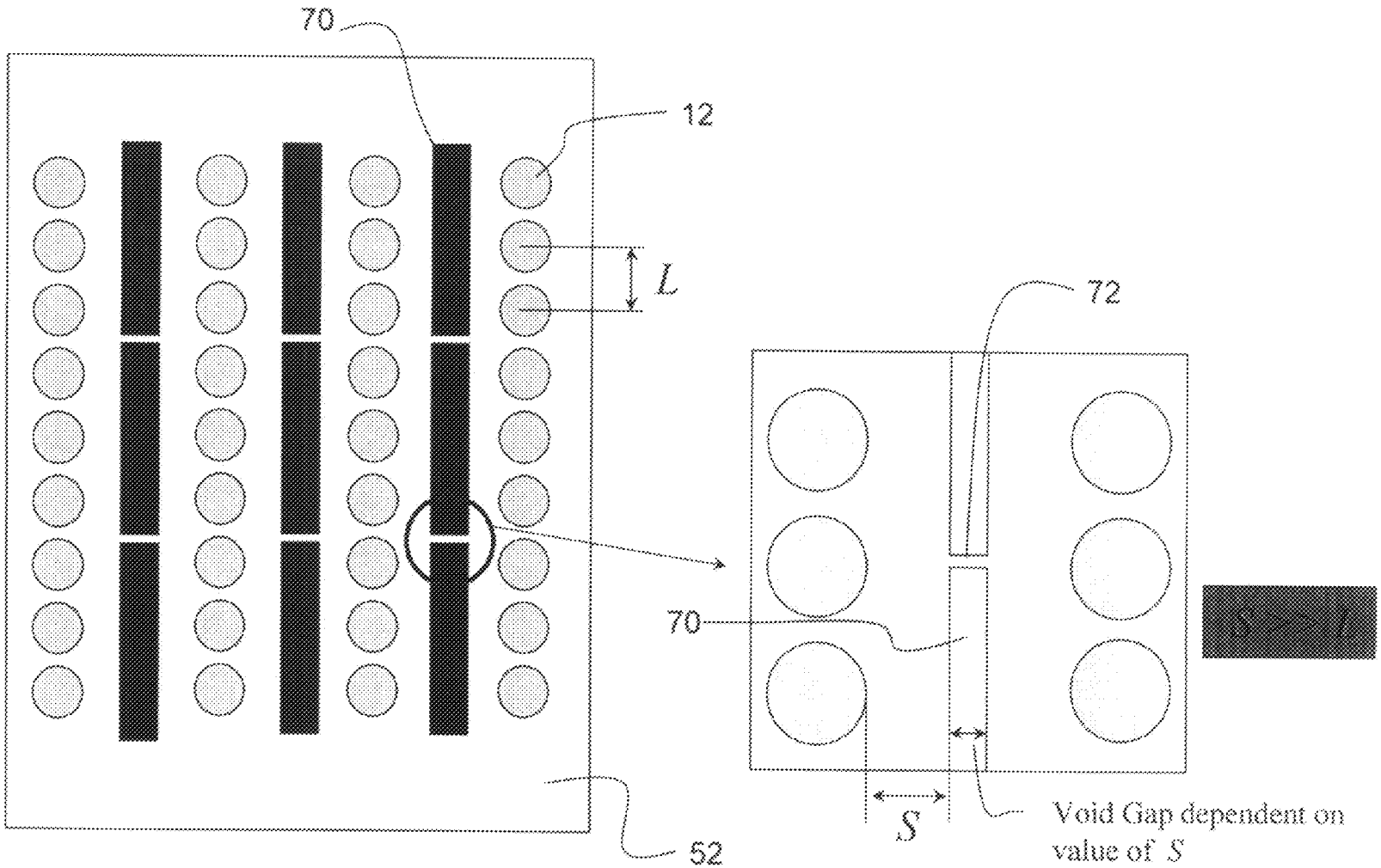
FIGS. 16A and 16B illustrate an exemplary embodiment low stress array of microcavity plasma devices with stress relief features fabricated in metal foil.
Figures 17A, 17B:
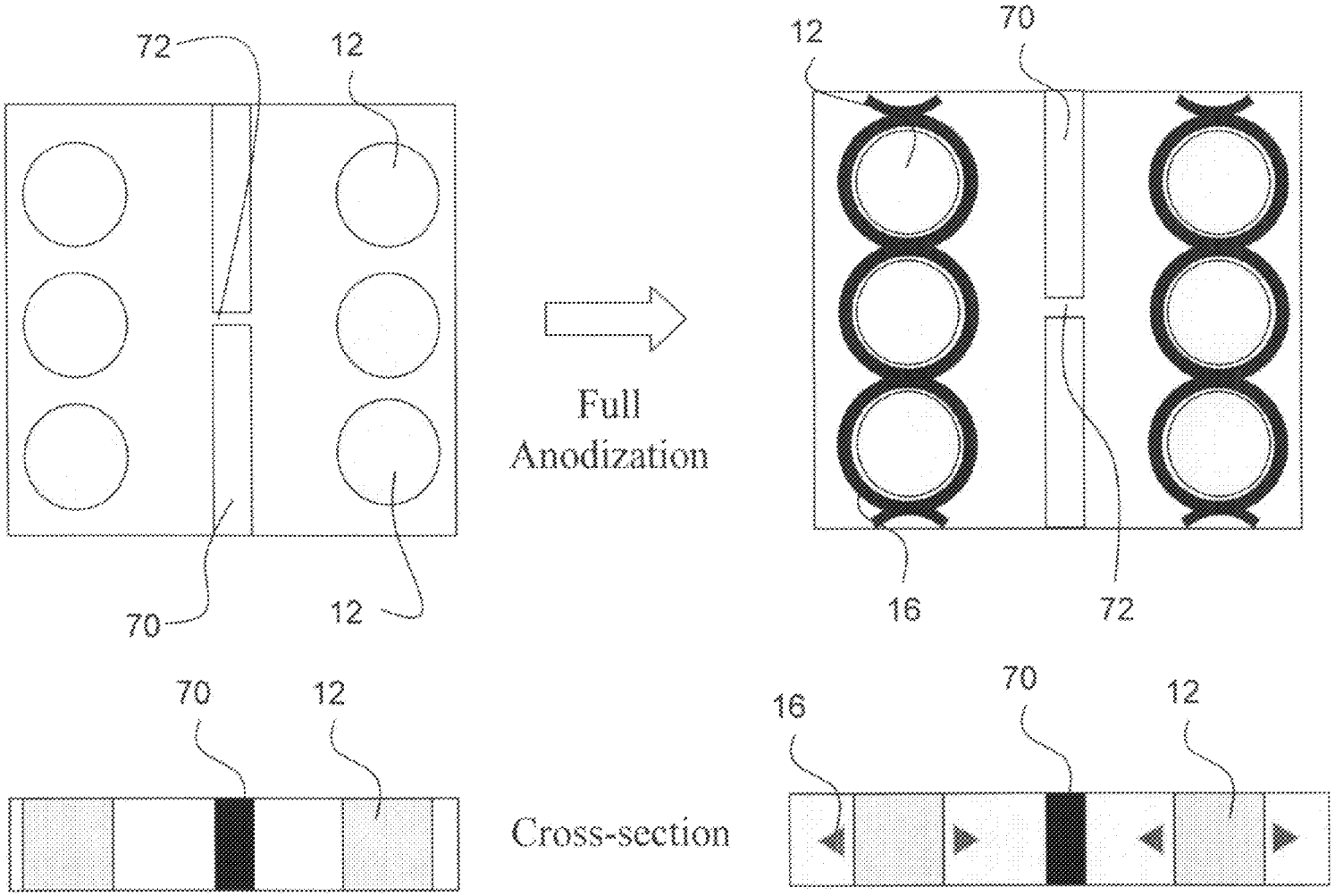
FIGS. 17A and 17B illustrate an exemplary embodiment fabrication process of the plasma device array of FIGS. 16A and 16B.

Stress relief voids 70 are used in additional preferred embodiments illustrated in FIGS. 16 and 17. Voids 70 are formed in metal foil before, after or at the same time as the microcavities. By producing voids 70 prior to anodization, stress is relieved during the anodization process and also thereafter. As for all of the structures discussed earlier, this array is inexpensive and uncomplicated to manufacture. Microcavities 12 are again produced in metal foil by any one of a variety of methods, including mechanical punching, chemical etching, and laser ablation. Furthermore, rectangular slots (or other shapes) are also produced in the same fashion as the microcavities. The voids 70 lie between each row (or column) of microcavities and the voids serve to alleviate the propagation and buildup of stress within the array. For mechanical stability and strength, a thin bridge 72 of metal is preferably retained between adjacent voids. These bridges 72 improve the mechanical integrity of the structure. Also, if L and S denote the pitch between adjacent microcavities in a row of microcavities and the minimum distance from a microcavity to the near edge of a rectangular slot, respectively, then it is desirable, in general, to have S>>L (S is substantially larger than L). FIG. 17B shows that once the proper configuration of microcavities 12 and voids 70 is obtained, the final step is to anodize. Having stress relief voids 70 between every row (or column) of microcavities 12 may not be necessary. Situating them after every second (or more) row may be sufficient.

Figure 18B:
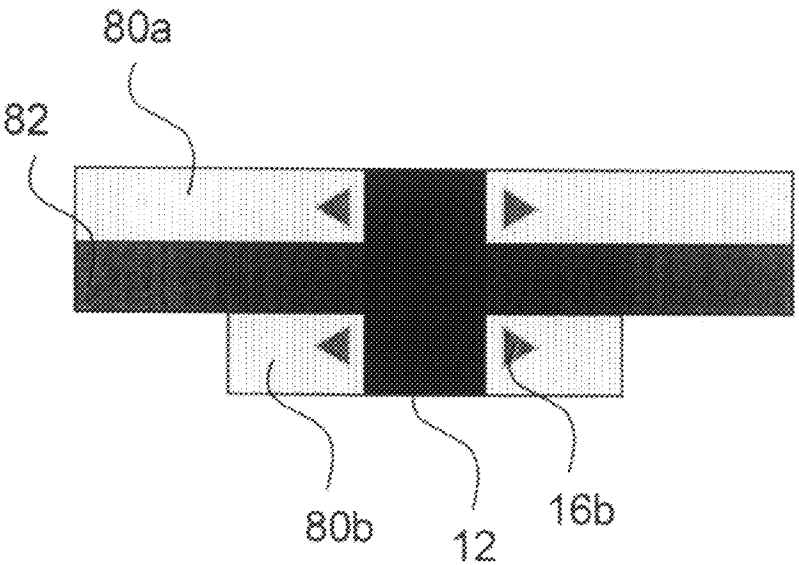
FIGS. 18A and 18B are a schematic cross-sectional views of additional exemplary embodiment low stress microcavity plasma devices with buried circumferential electrodes.
Figure 18A:
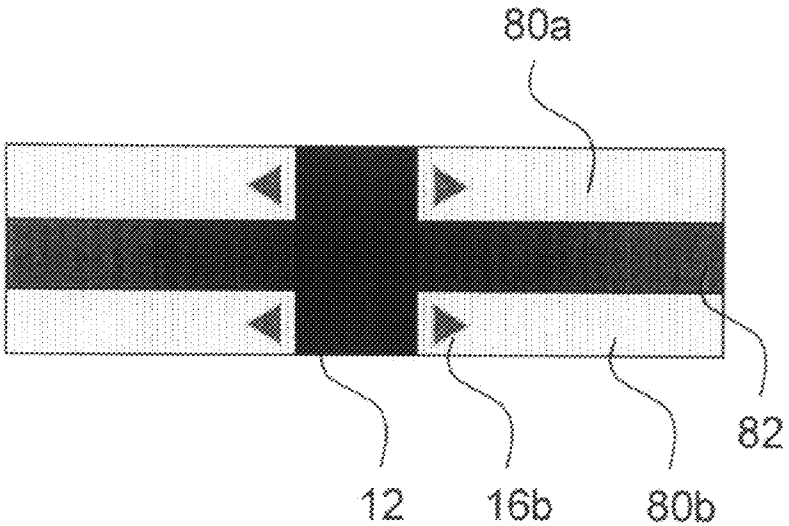

Embodiments of the invention based on metal films 80*a* and 80*b*, which are formed around a substrate 82B, are shown in FIGS. 18A and 18B. In this design, a layer of metal is deposited onto both sides of a substrate 82. Prior to depositing the metal films 80*a*, 80*b*, one or more microcavities 12 having the desired geometry are produced in the substrate by any of a variety of processes. After the desired microcavity array is produced, the metal film 80*a*, 80*b* is deposited onto the substrate and the metal is subsequently anodized. Anodization converts metal into metal oxide, leaving behind the circumferential electrodes 16*a*, 16*b*. If the microcavities are cylindrical in cross-section, the self-patterned electrodes will be cylindrical. However, the anodization process stops when the substrate is reached and, therefore, the process can be said to be "self-limiting." This structure and formation method limits the volume of metal to be anodized and has other advantages. One of these is that the substrate provides mechanical support for the thin metal oxide layer and serves as a spacer of precise thickness between the electrodes 16*a*, 16*b*. Since the anodization process requires only low temperatures (typically ≦50° C.), the substrate 82 can be chosen from a wide variety of materials including plastics and Kapton.

The substrate 82 can be flexible and/or transparent, if desired. The only requirement for the substrate is that it should be impervious to the acid used in the anodization process. Flexible polymer film or glass are acceptable choices for the substance. Also, when the metal layer is deposited, metal can also be deposited into each microcavity 12. Anodization will, therefore, also produce a thin metal oxide film lining the microcavity wall.

Arrays of the invention have many applications. Addressable devices can be used as the basis for both large and small high definition displays, with one or more microcavity plasma devices forming individual pixels or sub-pixels in the display. Microcavity plasma devices in preferred embodiment arrays, as discussed above, are able to produce ultraviolet radiation suitable for exciting a phosphor so as to realize full color displays over large areas. An application for a non-addressable or addressable array is, for example, as the light source (backlight unit) for a liquid crystal display panel. Embodiments of the invention provide a lightweight, thin and distributed source of light that is preferable to the current practice of using a fluorescent lamp as the backlight source. Distributing the light from a localized lamp in a uniform manner over the entire rear surface of the liquid crystal display requires sophisticated optics. Arrays of the invention also have application, for example, in sensing and detection equipment, such as chromatography devices, and for phototherapeutic treatments (including photodynamic therapy).

The latter include the treatment of psoriasis (which requires ultraviolet light at ~308 nm), actinic keratosis and Bowen's disease or basal cell carcinoma. Inexpensive arrays sealed in glass or plastic now provide the opportunity for patients to be treated in a nonclinical setting (i.e., at home) and for disposal of the array following the completion of treatment. These arrays are also well-suited for the photocuring of polymers (which also requires ultraviolet radiation), or as large area, thin light panels for applications in which low-level lighting is desired.

In addition to its application to interconnecting microplasma devices, the formation method of the invention is applicable to inexpensively forming electrodes and interconnects for microelectronics and MEMs systems, arrays of capacitors, micro-cooling devices and systems, and printed circuit board (PCB) technologies.

While various embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the following claims.

The invention claimed is:

1. A microcavity plasma device array, comprising:

a plurality of microcavities defined in a first thin metal oxide layer;

thin metal first electrodes buried in said thin metal oxide layer positioned to excite plasma in said microcavities;

a second thin layer, containing a second electrode, arranged proximately to said first thin metal oxide layer;

discharge medium within the plurality of microcavities;

a packaging layer containing the discharge medium in the plurality of microcavities; and stress reducer means for reducing stress in the device array.

2. The array of claim 1, wherein said stress reducer means comprises regions of reduced oxide thickness in said thin metal oxide layer.

3. The array of claim 1, wherein said stress reducer means comprises voids disposed in regions between microcavities.

4. The array of claim 1, wherein said stress reducer means comprise support ribs disposed above and below said microcavities.

5. The array of claim 1, wherein said stress reducer means comprises a substrate and said first metal oxide layer comprises two films disposed on separate sides of said substrate.

6. The array of claim 1, wherein said first thin metal oxide layer and said second thin layer are sufficiently thin to permit the array to be flexible.

7. The array of claim 1, wherein said packaging layer comprises polymeric packaging and a gas diffusion barrier.

8. The array of claim 1, said first electrodes comprise buried circumferential electrodes that surround microcavities defined in said first thin oxide layer.

9. The array of claim 1, wherein said first and second electrodes comprise aluminum and said metal oxide comprise aluminum oxide.

10. The array of claim 1, wherein said packaging layer is transparent.

11. The array of claim 1, further comprising interconnections buried in said first metal oxide layer for connecting two or more of said first electrodes.

12. The array of claim 1, wherein the discharge medium contained by said packaging layer is at or near atmospheric pressure.

13. The array of claim 1, wherein said second thin layer comprises a second thin oxide layer and said second electrode comprises a plurality of second electrodes.

14. The array of claim 2, wherein said regions of reduced oxide thickness are disposed in regions between microcavities.

15. The array of claim 3, further including narrow bridges between voids.

16. The array of claim 3, wherein the minimum distance from a microcavity to a void is substantially greater than the pitch between adjacent microcavities in a row of microcavities.

17. The array of claim 11, wherein the interconnection of said first electrodes is according to a pattern.

18. The array of claim 12, wherein said packaging layer comprises a thin layer of glass, quartz or plastic.

19. A thin metal-metal oxide electrode, comprising:

a thin metal buried in a thin metal oxide layer;

and stress reducer means for reducing stress in the electrode.

20. The electrode of claim 19, wherein said stress reducer means comprises regions of reduced oxide thickness in said thin metal oxide layer.

21. The electrode of claim 19, wherein said stress reducer means comprises support ribs disposed on opposite sides of the thin metal oxide layer.

22. The electrode of claim 19, wherein said thin metal comprises a parallel array of metal line electrodes and said stress reducer means comprises the thin metal oxide layer being symmetrical with respect to both ends of the parallel array of metal line electrodes.

23. The electrode of claim 21, wherein said support ribs on one side of the thin metal oxide layer are vertically interlaced with respect to support ribs on the other side of the thin metal oxide layer.

24. The electrode of claim 23, wherein said support ribs on the one side of the thin metal oxide layer have different widths than said support ribs on the other side of the thin metal oxide layer.

* * * * *